US011094280B2

(12) United States Patent
Jang et al.

(10) Patent No.: US 11,094,280 B2
(45) Date of Patent: Aug. 17, 2021

(54) LEVEL SHIFTER AND DISPLAY DEVICE USING THE SAME

(71) Applicant: LG Display Co., Ltd., Seoul (KR)

(72) Inventors: Hoon Jang, Paju-si (KR); Juno Hur, Paju-si (KR); Dong Ju Kim, Paju-si (KR); Soon Dong Cho, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/930,951

(22) Filed: Jul. 16, 2020

(65) Prior Publication Data

US 2021/0020137 A1 Jan. 21, 2021

(30) Foreign Application Priority Data

Jul. 17, 2019 (KR) ..... 10-2019-0086616

(51) Int. Cl.
*G09G 3/36* (2006.01)

(52) U.S. Cl.
CPC ..... *G09G 3/3688* (2013.01); *G09G 3/3677* (2013.01); *G09G 2310/0289* (2013.01); *G09G 2310/0297* (2013.01); *G09G 2310/066* (2013.01); *G09G 2310/08* (2013.01); *G09G 2330/06* (2013.01)

(58) Field of Classification Search
CPC ..... G09G 3/36; G09G 3/3677; G09G 3/3688; G09G 2310/0289; G09G 2310/0297; G09G 2310/066; G09G 2310/08; G09G 2330/00
See application file for complete search history.

(56) References Cited

U.S. PATENT DOCUMENTS 8,416,006 B1 * 4/2013 Timonen ..... G09G 3/3677 327/333
2005/0134533 A1 * 6/2005 Sasada ..... G09G 3/296 345/60
2007/0279093 A1 * 12/2007 Senda ..... H03K 19/018521 326/81
2007/0290983 A1 12/2007 Kim et al.
2008/0136756 A1 * 6/2008 Yeo ..... G09G 3/3677 345/87
2018/0114500 A1 * 4/2018 Jung ..... G09G 3/3674
2018/0151125 A1 * 5/2018 Lee ..... G09G 3/3233
2019/0197972 A1 * 6/2019 Wu ..... G02F 1/13454

FOREIGN PATENT DOCUMENTS

KR 10-2007-0120221 A 12/2007

* cited by examiner

*Primary Examiner* — Michael J Eurice
(74) *Attorney, Agent, or Firm* — Morgan, Lewis & Bockius LLP

(57) ABSTRACT

The present disclosure relates to a level shifter and a display device using the same, and the level shifter includes a first transistor configured to increase a voltage of an output signal, a second transistor configured to lower a voltage of the output signal, a first driver configured to vary a gate voltage of the first transistor in response to a first Vgs signal being varied within a transition time of the output signal, and a second driver configured to vary a gate voltage of the second transistor in response to a second Vgs signal being varied within a transition time of the output signal.

17 Claims, 26 Drawing Sheets

LEVEL SHIFTER AND DISPLAY DEVICE USING THE SAME

CROSS-REFERENCE TO RELATED APPLICATION

This application claims priority to and the benefit of Korean Patent Application No. 10-2019-0086616, filed Jul. 17, 2019, the disclosure of which is incorporated herein by reference in its entirety.

BACKGROUND

Technical Field

The present disclosure relates to a level shifter that converts a voltage level of an input signal and a display device using the same.

Discussion of Related Art

A driving circuit of a flat panel display (FPD) writes pixel data of an input image to pixels of a display panel so that the input image is reproduced on a pixel array. The driving circuit includes a data driving circuit configured to supply a pixel data signal to data lines, a gate driving circuit configured to supply a gate signal (or a scan signal) to gate lines (or scan lines), a timing controller configured to control operation timing of the data driving circuit and the gate driving circuit, and the like.

The timing controller may control the output of the data driving circuit and the gate driving circuit. The voltage level of a signal output from the timing controller may be converted through a level shifter.

SUMMARY

In order to improve electromagnetic interference (EMI), a slew rate of an output waveform of a level shifter may be adjusted to be low. To this end, the slope of a control signal that controls gate-source voltages Vgs of transistors constituting an output buffer of the level shifter may be reduced.

When the slope of each of output signals is reduced in the level shifter, the EMI is improved on a line through which the output signal is transmitted, but due to the variation in threshold voltages Vth of the transistors of the level shifter, a difference may occur in a transition time of a rising and/or falling edge of the output signal between output terminals of the level shifter. The difference in the transition time affects an output signal of a data driving circuit or gate driving circuit, thereby causing a lack of charging time of pixels.

Accordingly, embodiments of the present disclosure are directed to a level shifter and a display device using the same display device that substantially obviate one or more of the problems due to limitations and disadvantages of the related art.

Further, an aspect of the present disclosure is to provide a level shifter capable of improving EMI and reducing the difference in transition times of output signals of the level shifter, and a display device using the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a level shifter comprises a first transistor configured to increase a voltage of an output signal, a second transistor configured to lower a voltage of the output signal, a first driver configured to vary a gate voltage of the first transistor in response to a first Vgs signal being varied within a transition time of the output signal, and a second driver configured to vary a gate voltage of the second transistor in response to a second Vgs signal being varied within a transition time of the output signal.

In another aspect, a display device comprises a display panel including a pixel array in which data lines and gate lines intersect each other and pixels to which pixel data is written are arranged, a data driver configured to convert the pixel data into a data signal, a demultiplexer array configured to distribute the data signal from the data driver to the data lines, a gate driver configured to sequentially supply a gate signal to the gate lines, a timing controller configured to transmit the pixel data to the data driver and generate a control signal for controlling operation timing of the data driver, the gate driver, and the demultiplexer, a level shifter, and a power supply configured to generate a voltage required for driving the pixel array, the data driver, the gate driver, and the timing controller.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
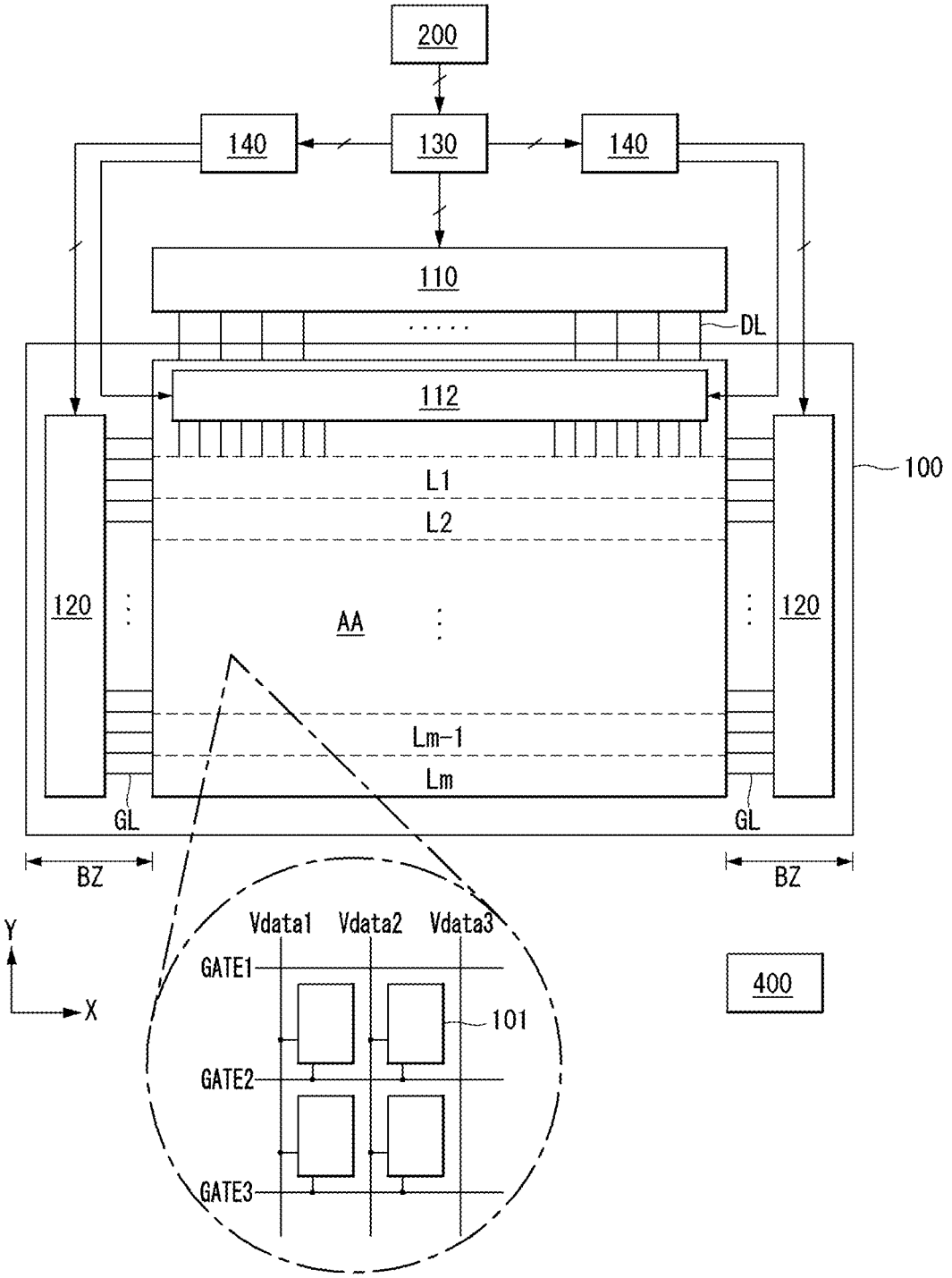
FIG. 1 is a block diagram illustrating a display device according to an embodiment of the present disclosure.

Advantages and features of the present disclosure and implementation methods thereof will be clarified through the following embodiments described with reference to the accompanying drawings. However, the present disclosure is not limited to the embodiments described below and may be embodied with a variety of different modifications. The embodiments are merely provided to allow those skilled in the art to completely understand the scope of the present disclosure, and the present disclosure is defined only by the scope of the claims.

The figures, dimensions, ratios, angles, numbers, and the like disclosed in the drawings for describing the embodiments of the present disclosure are merely illustrative and thus the present disclosure is not limited to matters illustrated in the drawings. Throughout the specification, like reference numerals refer to substantially like components. Further, in describing the present disclosure, detailed descriptions of well-known technologies will be omitted when it is determined that they may unnecessarily obscure the gist of the present disclosure.

Terms such as "including," "having," and "composed of" used herein are intended to allow other elements to be added unless the terms are used with the term "only." Any references to the singular may include the plural unless expressly stated otherwise.

Components are interpreted to include an ordinary error range even if not expressly stated.

For a description of a positional relationship, for example, when the positional relationship between two components is described as "on," "above," "below," "next to," and the like, one or more components may be interposed therebetween unless the term "immediately" or "directly" is used in the expression.

Although the terms first, second, and the like are used to distinguish the components, the functions or structures of these components are not limited by the ordinal number before the component or the name of the component. Since the claims are described with respect to the essential components, the ordinal numbers applied before the component names of the claims and the ordinal numbers applied before the component names of the embodiments may not be matched.

The following embodiments may be partially or entirely bonded to or combined with each other and may be interoperated and performed in technically various ways. Each of the embodiments may be independently operable with respect to each other and may be implemented together in related relationships.

In a display device of the present disclosure, a display panel driving circuit, a pixel array, a level shifter, and the like may each include transistors. The transistors may be implemented as oxide thin-film transistors (TFTs) including an oxide semiconductor, low-temperature polysilicon (LTPS) TFTs including LTPS, and the like. Each of the transistors may be implemented as a transistor having a p-channel metal-oxide-semiconductor field-effect transistor (MOSFET) structure or an n-channel MOSFET structure.

The transistor is a three-electrode element including a gate, a source, and a drain. The source is an electrode that provides carriers to the transistor. The carriers in the transistor start to flow from the source. The drain is an electrode through which the carriers are discharged from the transistor to the outside. In the transistor, carriers flow from the source to the drain. In the case of an n-channel transistor, carriers are electrons, and thus a source voltage is lower than a drain voltage so that the electrons flow from the source to the drain. In the n-channel transistor, current flows from the drain to the source. In the case of a p-channel transistor (PMOS), carriers are holes, and thus a source voltage is higher than a drain voltage so that the holes flow from the source to the drain. In the p-channel transistor, since the holes flow from the source to the drain, current flows from the source to the drain. It should be noted that the source and drain of the transistor are not fixed in position. For example, the source and drain are interchangeable depending on the applied voltage. Accordingly, the present disclosure is not limited by the source and drain of the transistor. In the following description, the source and the drain of the transistor will be referred to as a first electrode and a second electrode.

A gate signal transitions between a gate-on voltage and a gate-off voltage. The gate-on voltage is set to be higher than a threshold voltage of the transistor, and the gate-off voltage is set to be lower than the threshold voltage of the transistor. The transistor is turned on in response to the gate-on voltage and turned off in response to the gate-off voltage. In the case of an n-channel transistor, the gate-on voltage may be a gate-high voltage VGH, and the gate-off voltage may be a gate-low voltage VGL. In the case of a p-channel transistor, the gate-on voltage may be a gate-low voltage VGL, and the gate-off voltage may be a gate-high voltage VGH.

The present disclosure is applicable to any flat panel display device requiring a level shifter such as a liquid crystal display (LCD), an organic light-emitting display (OLED), and the like.

Hereinafter, various embodiments of the present disclosure will be described in detail with reference to the accompanying drawings.

Referring to FIG. 1, a display device according to an embodiment of the present disclosure includes a display panel 100 and a display panel driving circuit.

The display panel 100 includes a pixel array AA that displays pixel data of an input image. The pixel data of the input image is displayed on pixels of the pixel array AA. The pixel array AA includes a plurality of data lines DL, a plurality of gate lines GL intersecting the data lines DL, and pixels arranged in a matrix form. In addition to the matrix form, the pixels may be arranged in various forms, such as a form in which pixels emitting the same color are shared, a stripe form, a diamond form, and the like.

When the pixel array AA has a resolution of n×m, the pixel array AA includes n pixel columns and m pixel lines L1 to Lm that intersect the pixel columns. The pixel column includes pixels arranged in a y-axis direction. The pixel line includes pixels arranged in an x-axis direction. One horizontal period 1H is a time obtained by dividing one frame period by the number of m pixel lines L1 to Lm. Pixel data is written to pixels of one pixel line in one horizontal period 1H.

Each of the pixels may be divided into a red sub-pixel, a green sub-pixel, and a blue sub-pixel for a color implementation. Each of the pixels may further include a white sub-pixel. Each of sub-pixels 101 includes a pixel circuit. The pixel circuit includes a pixel electrode, a plurality of TFTs, and a capacitor. The pixel circuit is connected to a data line DL and a gate line GL.

Touch sensors may be disposed on the display panel 100 to implement a touch screen. Touch input may be sensed using separate touch sensors or may be sensed through the pixels. The touch sensors may be arranged on a screen of the display panel as an on-cell type or add-on type, or may be implemented as in-cell type touch sensors embedded in the pixel array.

The display panel driving circuit includes a data driver 110, a gate driver 120, and a timing controller 130 for controlling the operation timing of the driving circuits 110 and 120. The display panel driving circuit writes data of an input image to the pixels of the display panel 100 under the control of the timing controller 130.

The data driver 110 converts pixel data V-DATA of an input image received as a digital signal from the timing controller 130 into analog gamma compensation voltage for every frame to output data signals Vdata1 to Vdata3. The data driver 110 supplies the data signals Vdata1 to Vdata3 to the data lines DL. The data driver 110 outputs the data signals Vdata1 to Vdata3 using a digital-to-analog converter (hereinafter referred to as a "DAC") that converts a digital signal into analog gamma compensation voltage. The data driver 110 may be integrated in a source driver integrated circuit (IC) 110*a* illustrated in FIGS. 7A and 7B. The source driver IC 110*a* may be mounted on a chip-on-film (COF) and connected between a source printed circuit board (PCB) 152 and the display panel 100. A touch sensor driver for driving the touch sensors may be embedded in each source driver IC 110*a*.

The gate driver 120 may be formed in a bezel area BZ in which an image is not displayed in the display panel 100. The gate driver 120 receives a gate timing control signal transmitted from a level shifter 140, generates gate signals GATE1 to GATE3 (or scan signals), and supplies the generated gate signals GATE1 to GATE3 to the gate lines GL. The gate signals GATE1 to GATE3 applied to the gate lines GL turn on switching elements of the sub-pixels to select pixels to which voltages of the data signals Vdata1 to Vdata3 are charged. The gate signals GATE1 to GATE3 may be generated as pulse signals that swing between a gate-high voltage VGH and a gate-low voltage VGL. The gate driver 120 shifts the gate signals using a shift register.

The timing controller 130 may multiply an input frame frequency by i and control the operation timing of the drivers 110 and 120 in the display panel with a frame frequency of the input frame frequency×i Hz (here "i" is a positive integer greater than 0). The frame frequency is 60 Hz in the National Television Standards Committee (NTSC) scheme and 50 Hz in the Phase-Alternating Line (PAL) scheme.

The timing controller 130 receives pixel data of an input image and timing signals synchronized with the pixel data from a host system 200. The pixel data of the input image received by the timing controller 130 is a digital signal. The timing controller 130 transmits the pixel data to the data driver 110. The timing signals include a vertical synchronization signal Vsync, a horizontal synchronization signal Hsync, a clock signal DCLK, a data enable signal DE, and the like. The vertical synchronization signal Vsync and the horizontal synchronization signal Hsync may be omitted since a vertical period and a horizontal period may be obtained by a method of counting the data enable signal DE. The data enable signal DE has a period of one horizontal period 1H.

The display panel driving circuit may further include a demultiplexer array 112 disposed between the data driver 110 and the gate driver 120.

Figure 2:
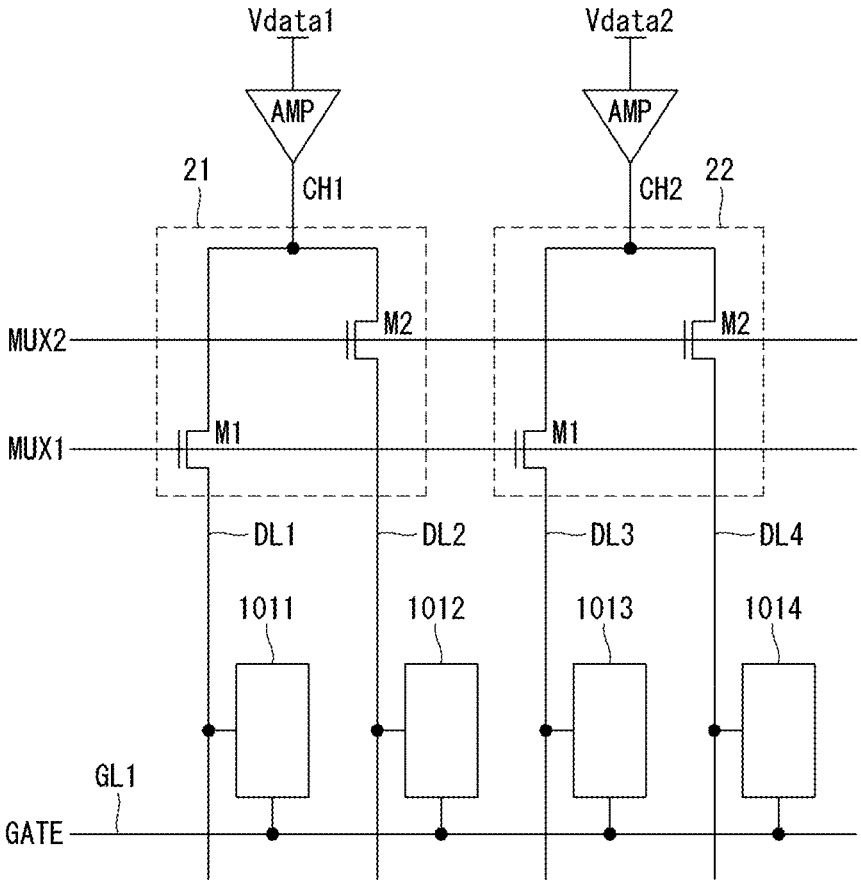
FIG. 2 is a circuit diagram illustrating switching elements of a demultiplexer array.

The demultiplexer array 112 may time-divide the data voltage output from the one channel of the data driver 110 and distribute the time-divided data voltage to the data lines DL by sequentially connecting one channel of the data driver 110 to the plurality of data lines DL, thereby reducing the number of channels of the data driver 110. The demultiplexer array 112 includes a plurality of switching elements as illustrated in FIG. 2.

The timing controller 130 may generate a data timing control signal for controlling the data driver 110, a gate timing control signal for controlling the gate driver 120, a MUX control signal for controlling the switching elements of the demultiplexer array 112, and the like based on the timing signals received from the host system 200. The gate timing control signal may include a gate start pulse VST, a shift clock GCLK, and the like. The gate start pulse VST controls start timing of the gate driver 120 for every frame period. The shift clock GCLK controls shift timing of the gate signal output from the gate driver 120. The timing controller 130 may generate a control signal for controlling the level shifter 140.

The host system 200 may be one among a television (TV), a set-top box, a navigation system, a personal computer (PC), a home theater device, a mobile system, and a wearable system. In the mobile system and the wearable system, the data driver 110, the timing controller 130, and the level shifter 140 may be integrated in a single driver IC (not shown).

In the mobile system, the host system 200 may be implemented as an application processor (AP). The host system 200 may transmit pixel data of an input image to the driver IC through a mobile industry processor interface (MIPI). The host system 200 may be connected to the driver IC through a flexible printed circuit, for example, a flexible printed circuit (FPC).

The level shifter 140 converts voltage of the control signal received from the timing controller 130. For example, the level shifter 140 converts high logic voltage (or high potential input voltage) of the input signal, which is received at a digital signal voltage level, into a gate-high voltage VGH, and converts low logic voltage (or low potential input voltage) of the input signal into a gate-low voltage VGL.

An output signal of the level shifter 140 may be applied to at least one among the demultiplexer array 112, the gate driver 120, the data driver 110, the touch sensor driver, and a power supply 400. The level shifter 140 of the present disclosure includes a controller that controls a gate-source voltage Vgs of transistors constituting an output buffer. Such a controller may be added to at least one of the gate driver 120, the data driver 110, the touch sensor driver, and the power supply 400 separately from the level shifter 140.

The display device of the present disclosure further includes the power supply 400.

The power supply 400 generates a direct current (DC) voltage required for driving the pixel array and the display panel driving circuit of the display panel 100 by using a DC-DC converter. The DC-DC converter may include a charge pump, a regulator, a buck converter, a boost converter, a buck-boost converter, and the like. The power supply 400 may adjust a DC input voltage from the host system 200 to generate the DC voltages such as a gamma reference voltage VGMA, gate high voltages VGH and VEH, gate low voltages VGL and VEL, a half VDD (HVDD), a common voltage for pixels, and the like. The gamma reference voltage VGMA is supplied to the data driver 110. The voltage of the half VDD may be about half the voltage of VDD and may be used as a driving voltage of an output buffer of the source driver IC. The gamma reference voltage VGMA is divided according to a gray scale using a voltage dividing circuit and supplied to the DAC of the data driver 110.

FIG. 2 is a circuit diagram illustrating switching elements M1 and M2 of the demultiplexer array 112.

Referring to FIG. 2, an output buffer AMP included in one channel CH1 or CH2 in the data driver 110 may be connected to neighboring data lines DL1 to DL4 through the demultiplexer array 112. The data lines DL1 to DL4 may be connected to pixel electrodes 1011 to 1014 of the sub-pixels through TFTs.

The demultiplexer array 112 includes a plurality of demultiplexers 21 and 22. Each of the demultiplexers 21 and 22 may be a 1:N demultiplexer in which an input node is one and an output node is N (N is a positive integer greater than or equal to two). The demultiplexers 21 and 22 of the demultiplexer array 112 are exemplified in FIG. 2 as being 1:2 demultiplexers, but the present disclosure is not limited thereto. For example, each of the demultiplexers 21 and 22 may be implemented as a 1:3 demultiplexer to sequentially connect one channel in the data driver 110 to three data lines. The demultiplexer array 112 may be directly formed on a substrate of the display panel 100 or may be integrated into a single driver IC together with the data driver 110.

The demultiplexer array 112 includes a first demultiplexer 21 configured to time-divide a data signal Vdata1 output through a first channel CH1 of the data driver 110 using the switching elements M1 and M2 and distribute the time-divided data signal to first and second data lines DL1 and DL2 and a second demultiplexer 22 configured to time-divide a data signal Vdata2 output through a second channel CH2 of the data driver 110 using the switching elements M1 and M2 and distribute the time-divided data signal to third and fourth data lines DL3 and DL4.

The level shifter 140 may output first and second MUX signals MUX1 and MUX2 in response to the MUX control signal received from the timing controller 130.

The first switching element M1 is turned on in response to a gate-high voltage VGH of the first MUX signal MUX1. Here, the output buffer AMP of the first channel CH1 is connected to the first data line DL1 through the first switching element M1. At the same time, the output buffer AMP of the second channel CH2 is connected to the third data line DL3 through the first switching element M1.

The second switching element M2 is turned on in response to a gate-high voltage VGH of the second MUX signal MUX2. Here, the output buffer AMP of the first channel CH1 is connected to the second data line DL2 through the second switching element M2. At the same time, the output buffer AMP of the second channel CH2 is connected to the fourth data line DL4 through the second switching element M2.

Figure 3:
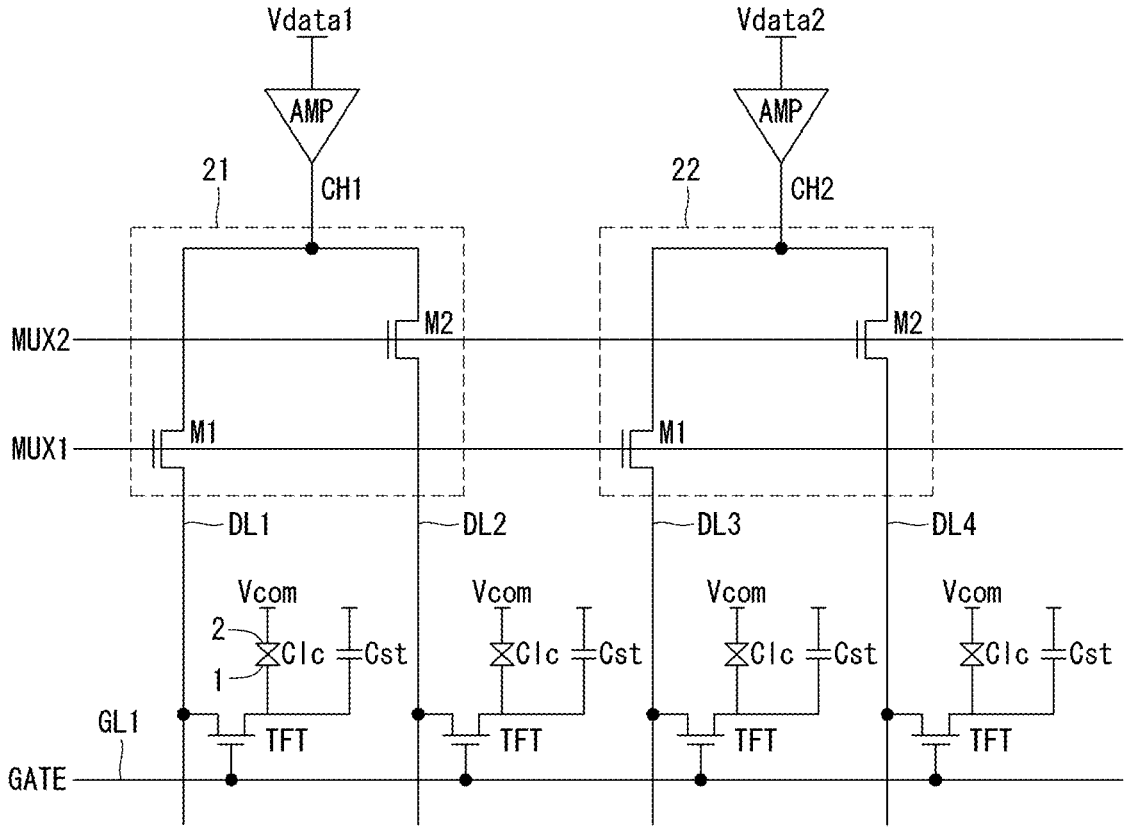
FIG. 3 is a diagram illustrating an example of a pixel circuit in a liquid-crystal display device.

FIG. 3 is a diagram illustrating an example of a pixel circuit in a liquid-crystal display device.

Referring to FIG. 3, each of the sub-pixels includes a pixel electrode 1, a common electrode 2, a liquid crystal cell Clc, a TFT connected to the pixel electrode 1, and a storage capacitor Cst. The TFT is formed at an intersection of each of data lines DL1 to DL4 and a gate line GL1. The TFT supplies voltage of a data signal Vdata from each of the data lines DL1 to DL4 to the pixel electrode 1 in response to a gate signal GATE from the gate line GL1.

A first demultiplexer 21 is connected between the first channel CH1 of the data driver 110 and the data lines DL1 and DL2. A second demultiplexer 22 is connected between the second channel CH2 of the data driver 110 and the data lines DL3 and DL4.

Sub-pixels of an organic light-emitting display device display an image by generating light according to pixel data of an input image using an organic light-emitting diode (hereinafter referred to as an "OLED") element as in an example of FIG. 4. The organic light-emitting display device does not require a backlight unit and may be implemented on a plastic substrate, a thin glass substrate, or a metal substrate with a flexible material. Accordingly, a flexible display may be implemented as the organic light-emitting display device.

In a flexible display, the size and shape of the screen may be varied as a method of rolling, folding, and bending a display panel. The flexible display may be implemented as a rollable display, a bendable display, a foldable display, a slidable display, or the like. Such a flexible display device is applicable not only to mobile devices such as smartphones and tablet PCs but also to TVs, automobile displays, wearable devices, and the like and the application field thereof is being expanded.

Each of pixels of the organic light-emitting display device includes an OLED, a driving element configured to drive the OLED by adjusting current flowing through the OLED according to a gate-source voltage Vgs, a storage capacitor configured to maintain a gate voltage of the driving element, and the like.

The driving element may be implemented as a transistor. In order to make the image quality of the entire screen of the organic light-emitting display device uniform, the driving element should have uniform electrical characteristics in all the pixels. Due to a process variation caused in the manufacturing process of a display panel and an element characteristic variation, there may be a difference in electrical characteristics of the driving element between the pixels, and such a difference may increase as the driving time of the pixels passes. In order to compensate for the electrical characteristic variation of the driving element between pixels, an internal compensation technique and/or external compensation technique may be applied to the organic light-emitting display device.

The external compensation technique uses an external compensation circuit to sense the current or voltage of the driving element, which changes according to the electrical characteristics of the driving element, in real-time. The external compensation technique is used to compensate for an electrical characteristic variation (or change) of the driving elements in the pixels by modulating pixel data (digital data) of an input image by as much as the electrical characteristic variation (or change) of the driving element sensed for each pixel.

The internal compensation technique uses an internal compensation circuit embedded in each of the pixels to sense a threshold voltage of the driving element for each sub-pixel and compensate for a gate-source voltage Vgs of the driving element by as much as the threshold voltage. The internal compensation circuit includes a storage capacitor Cst connected to a gate of a driving element DT, and one or more switching elements T1 to T5 configured to connect the storage capacitor Cst and the driving element DT to a light-emitting element EL.

The demultiplexer 21 and 22 may be applied to both the organic light-emitting display devices to which the internal compensation technique and the external compensation technique are applied. FIG. 4 illustrates an example in which the demultiplexer 21 is disposed in the organic light-emitting display device to which the internal compensation technique is applied, but the present disclosure is not limited thereto.

Figure 4:
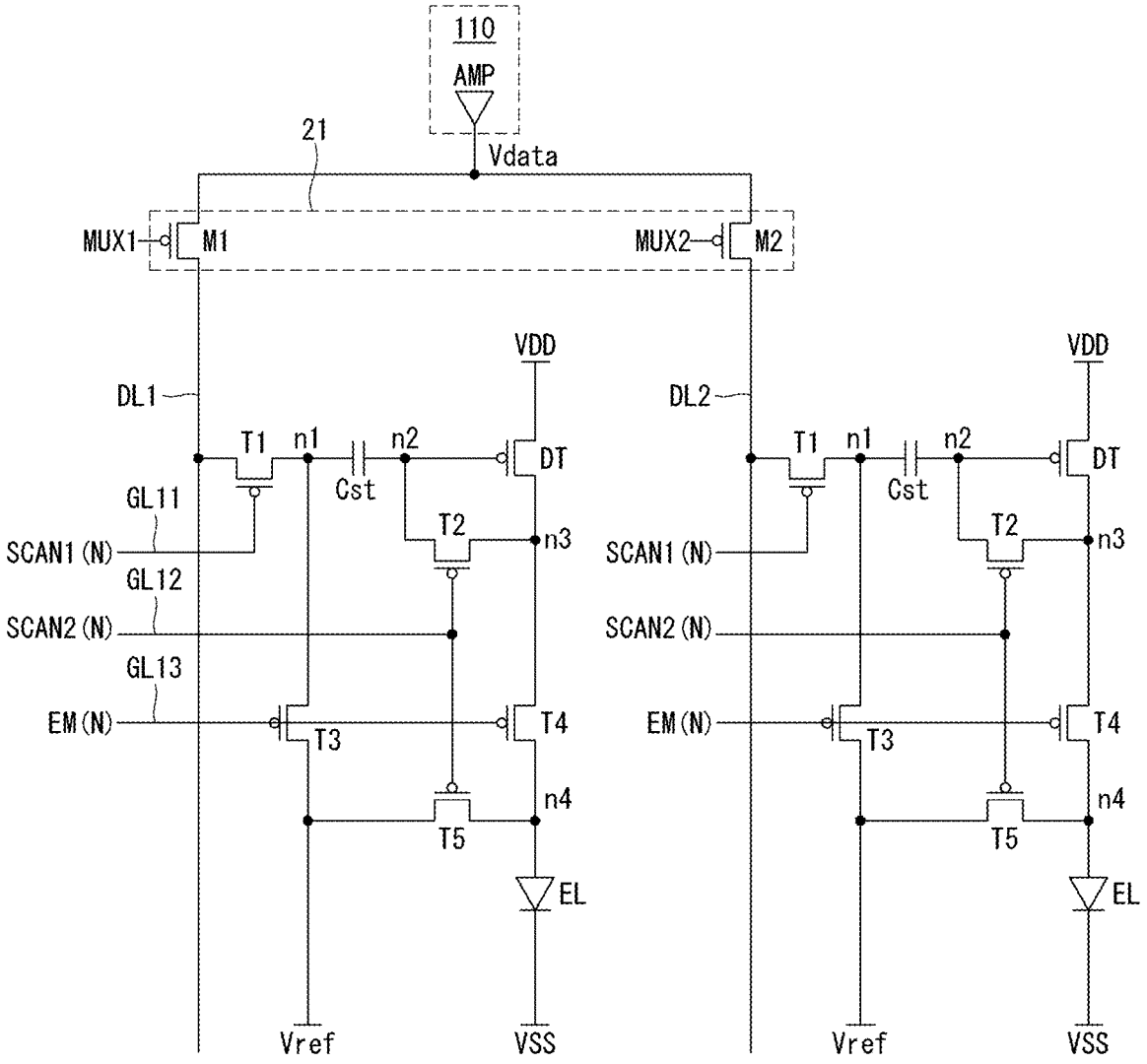
FIG. 4 is a diagram illustrating an example of a pixel circuit in an organic light-emitting display device.
Figure 5:
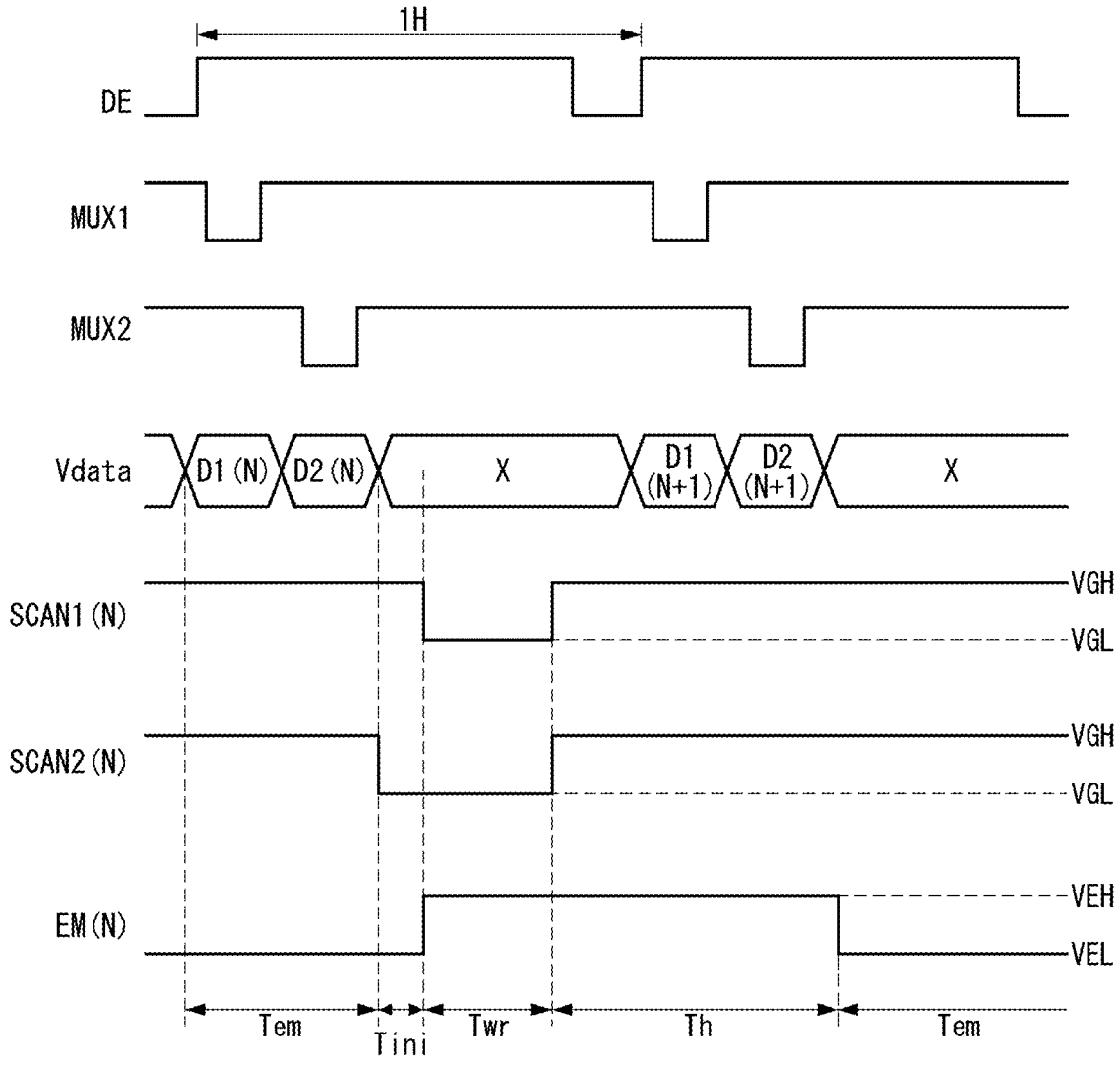
FIG. 5 is a waveform diagram illustrating the operation of a demultiplexer and the pixel circuit shown in FIG. 4.

Referring to FIGS. 4 and 5, gate signals in the organic light-emitting display device may include scan signals and an emission control signal (hereinafter, referred to as an "EM signal"). In FIG. 4, GL11 to GL13 are gate lines connected to sub-pixels of one pixel line. D1(N) and D2(N) are data signals Vdata applied to pixels of an nth pixel line. D1(N+1) and D2(N+1) are data signals Vdata applied to pixels of an (n+1)th pixel line. X is a section in which there is no data signal Vdata During one horizontal period 1H in which data is written to pixels of one pixel line, the pixels may be driven by being divided into an initialization period Tini, a data writing period Twr, and a holding period Th, as shown in FIG. 5.

The pixels may emit light during an emission period Tem. The emission period Tem corresponds to most of the time of one frame period excluding one horizontal period 1H from the one frame period. The holding period Th may be added between the data writing period Twr and the emission period Tem.

During the emission period Tem, an EM signal EM(N) may swing between a gate-low voltage VEL and a gate-high voltage VEH at a predetermined duty ratio in order to precisely express the brightness of a low gray scale.

During the initialization period Tini, a second scan signal SCAN2(N) is converted to a gate-low voltage VGL. At this time, the main nodes of a pixel circuit may be initialized.

During the data writing period Twr, a first scan signal SCAN1(N) is converted to a gate-low voltage VGL. At this time, the data signal Vdata is applied to one electrode of a capacitor Cst, and VDD-Vth is applied to the other electrode of the capacitor Cst. VDD-Vth is a voltage in which a pixel driving voltage VDD is lowered by as much as a threshold voltage Vth of the driving element DT since the driving element DT operates as a diode by a turned-on second switching element T2. During the data writing period Twr, when a gate-source voltage Vgs of the driving element DT reaches the threshold voltage Vth of the driving element DT, the driving element DT is turned off, the threshold voltage Vth of the driving element DT is sampled by the capacitor Cst, and the data signal Vdata whose voltage is compensated for as much as the threshold voltage Vth is charged to the capacitor Cst.

The light-emitting element EL may be implemented as an OLED. The OLED includes an organic compound layer formed between an anode and a cathode. The organic compound layer may include, but is not limited to, a hole injection layer HIL, a hole transport layer HTL, a light-emitting layer EML, an electron transport layer ETL, an electron injection layer EIL, and the like. The anode of the light-emitting element EL is connected to fourth and fifth switching elements T4 and T5 through a fourth node n4. A low potential power supply voltage VSS is applied to the cathode of the light-emitting element EL. The driving element DT supplies current to the light-emitting element EL according to the gate-source voltage Vgs thereof to drive the light-emitting element EL. The light-emitting element EL emits light with the current adjusted by the driving element DT according to the voltage of the data signal Vdata. A current path of the light-emitting element EL is switched by the fourth switching element T4.

The capacitor Cst is connected between a first node n1 and a second node n2. The voltage of the data signal Vdata, which is compensated for by as much as the threshold voltage Vth of the driving element DT, is charged to the capacitor Cst. Since the voltage of the data signal Vdata is compensated for by as much as the threshold voltage Vth of the driving element DT in each of the sub-pixels, a threshold voltage variation of the driving element DT in the sub-pixels may be compensated for.

A first switching element T1 is turned on in response to the gate-low voltage VGL of the first scan signal SCAN1(N) to supply the voltage of the data signal Vdata to the first node n1. The second switching element T2 is turned on in response to the gate-low voltage VGL of the second scan signal SCAN2(N) to connect the gate and a second electrode of the driving element DT. The driving element DT is operated as a diode by the second switching element T2 turned on in the data writing period Twr. The pulse of the second scan signal SCAN2(N) is converted to the gate-low voltage VGL before the first scan signal SCAN1(N) and is converted to a gate-high voltage VGH at the same time as the pulse of the first scan signal SCAN1(N). The pulse width of each of the first and second scan signals SCAN1(N) and SCAN2(N) may be set to be less than or equal to one horizontal period 1H.

During the initialization period Tini and the emission period Tem, a third switching element T3 is turned on in response to a gate-low voltage VEL of the EM signal EM(N) to supply a reference voltage Vref to the first node n1. During the initialization period Tini and the emission period Tem, the voltage of a first electrode of the capacitor Cst becomes the voltage of the low potential power supply voltage VSS due to the third switching element T3. During the data writing period Twr and the holding period Th, the pulse of the EM signal EM(N) may be generated as a gate-high voltage VEH in order to suppress the emission of the light-emitting element EL. The EM signal EM(N) may be converted to the gate-high voltage VEH when the first scan signal SCAN1(N) is converted to the gate-low voltage VGL and may be converted to the gate-low voltage VEL after the first and second scan signals SCAN1(N) and SCAN2(N) are converted to the gate-high voltage VEH.

During the initialization period Tini and the emission period Tem, the fourth switching element T4 is turned on in response to the gate-low voltage VEL of the EM signal EM(N) to connect a third node n3 to the fourth node n4. A gate of the fourth switching element T4 is connected to a gate of the third switching element T3. A first electrode of the fourth switching element T4 is connected to the third node n3, and a second electrode of the fourth switching element T4 is connected to the fourth node n4.

During the initialization period Tini and the data writing period Twr, the fifth switching element T5 is turned on in response to the gate-low voltage VGL of the second scan signal SCAN2(N) to supply the reference voltage Vref to the fourth node n4.

The driving element DT adjusts the current flowing through the light-emitting element EL according to the gate-source voltage Vgs thereof to drive the light-emitting element EL. The driving element DT includes the gate connected to the second node n2, a first electrode to which the pixel driving voltage VDD is supplied, and the second electrode connected to the third node n3.

Figure 6:
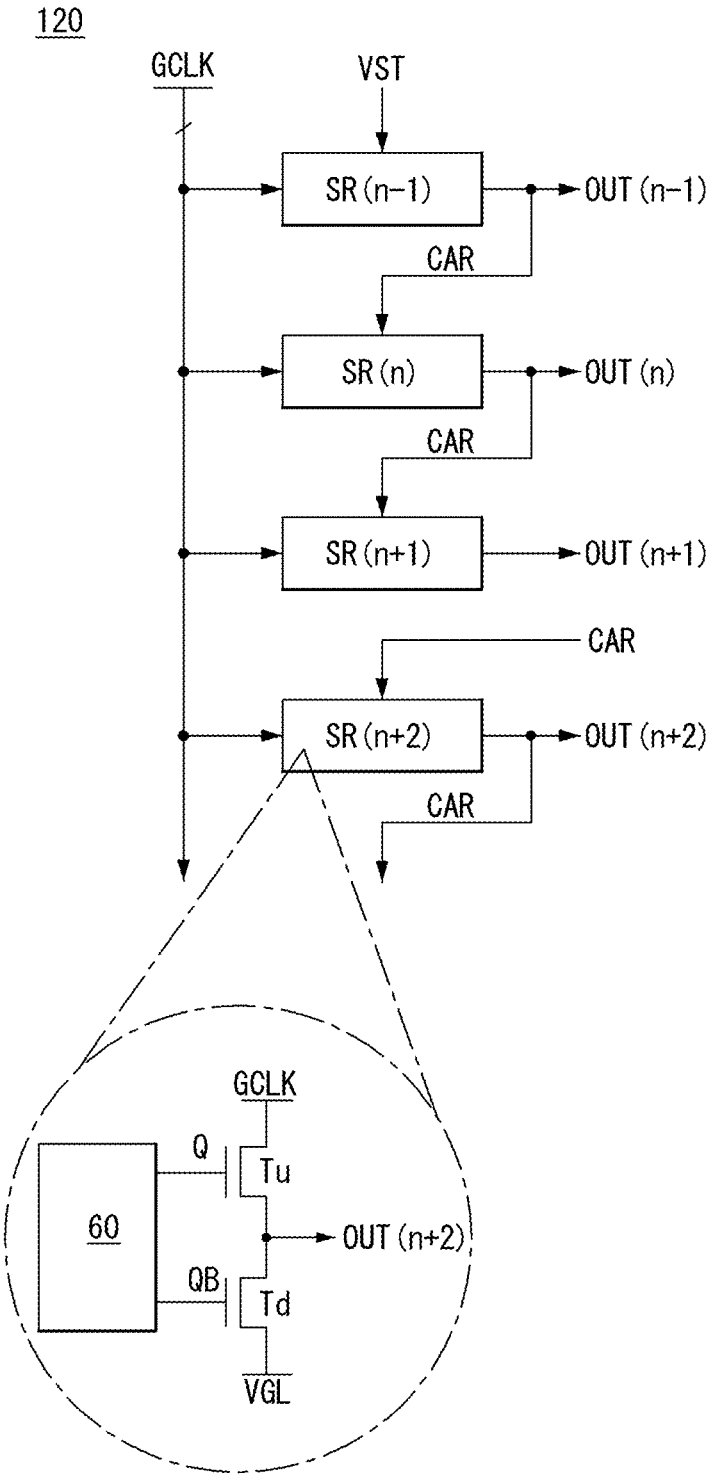
FIG. 6 is a schematic view illustrating a shift register of a data driver.

FIG. 6 is a schematic view illustrating the shift register of the gate driver 120. The shift register of the gate driver 120 includes stages SR(n−1) to SR(n+2) that are connected in a cascaded manner. The shift register receives the gate start pulse VST or a carry signal CAR and generates output signals OUT(n−1) to OUT(n+2) according to the timing of a clock GCLK. The carry signal CAR may be output from the previous stage.

Each of the stages SR(n−1) to SR(n+2) includes a controller 60 configured to charge and discharge a Q node and a QB node, and a buffer configured to charge a gate line according to the voltage of the Q node so that the waveform of a gate signal rises and discharge the gate line according to the voltage of the QB node. The buffer includes a pull-up transistor Tu and a pull-down transistor Td. The output signals OUT(n−1) to OUT(n+2) of the stages SR(n−1) to SR(n+2) are gate signals sequentially applied to the gate lines.

Figure 7A:
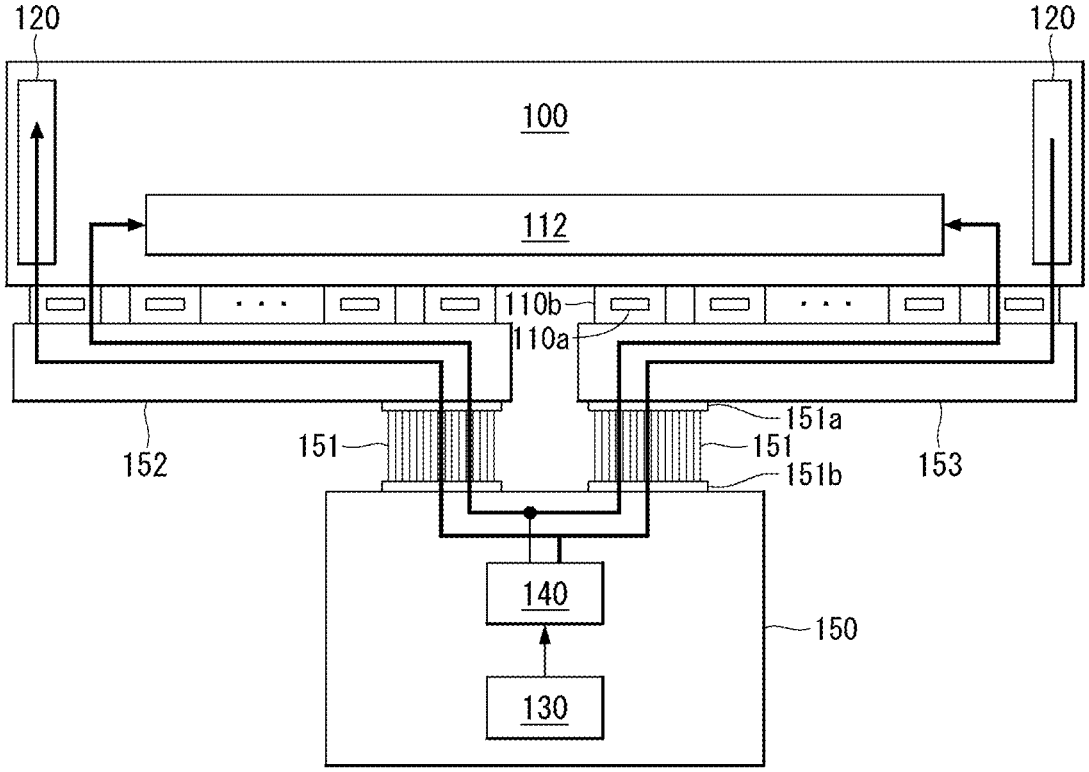
FIGS. 7A and 7B are views illustrating lines for a level shifter.
Figure 7B:
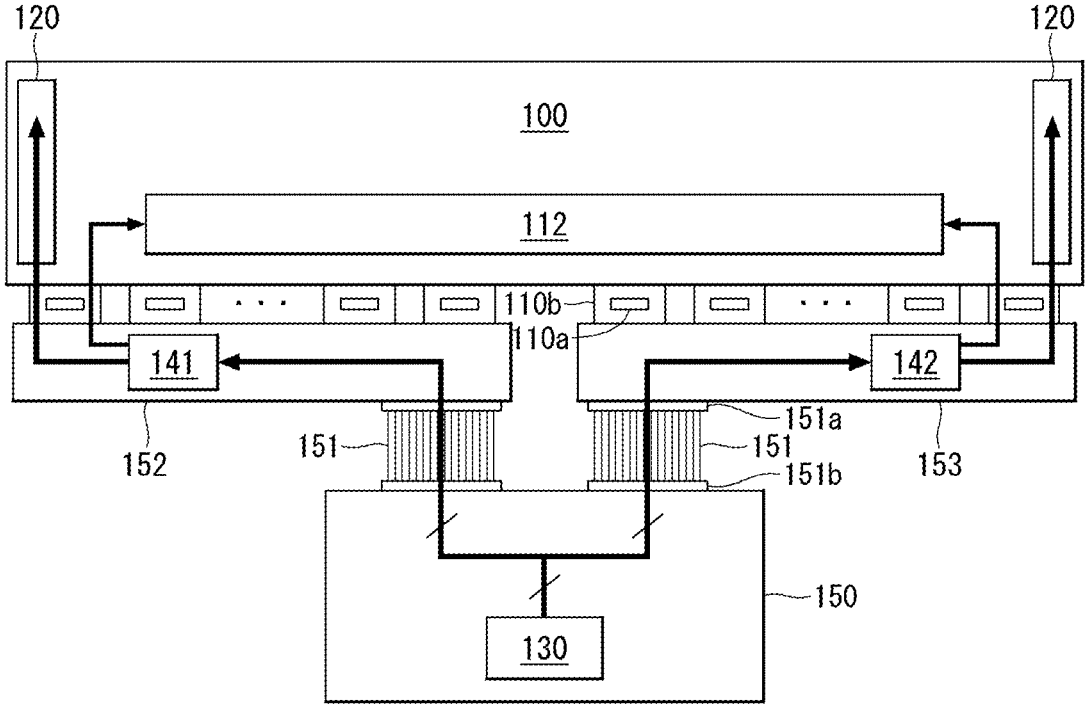

In a large screen display device, the source PCB 152 may be separated into two PCBs. FIGS. 7A and 7B are views illustrating lines required for the level shifter in a large-screen display device.

Referring to FIGS. 7A and 7B, a control board 150 may be connected to first and second source PCBs 152 and 153 through flexible circuit boards, for example, a flexible flat cable (FFC) 151 and a connector 151*a*. Source driver ICs 110*a* are connected between the source PCBs 152 and 153 and the display panel 100.

The timing controller 130 and the level shifter 140 may be mounted on the control board 150 as shown in FIG. 7A. In this case, input terminals of the level shifter 140 are connected to the timing controller 130 through lines formed on the control board 150. Output terminals of the level shifter 140 may be connected to gate drivers 120 through lines connecting the FFC 151, the source PCB 152, chip on films (COFs) 110*b*, and the gate driver 120 on the display panel 100.

The level shifter 140 may be mounted on each of the source PCBs 152 and 153 as shown in FIG. 7B. In this case, the level shifter 140 includes a first level shifter 141 mounted on the first source PCB 152 and a second level shifter 142 mounted on the second source PCB 153. Input terminals of the level shifters 141 and 142 are connected to the timing controller 130 through lines connecting the control board 150, the FFC 151, and the source PCBs 152 and 153. Output terminals of the level shifters 141 and 142 may be connected to the gate drivers 120 through lines connecting the source PCBs 152 and 153, the COFs 110*b*, and the gate driver 120 on the display panel 100.

Figure 8:
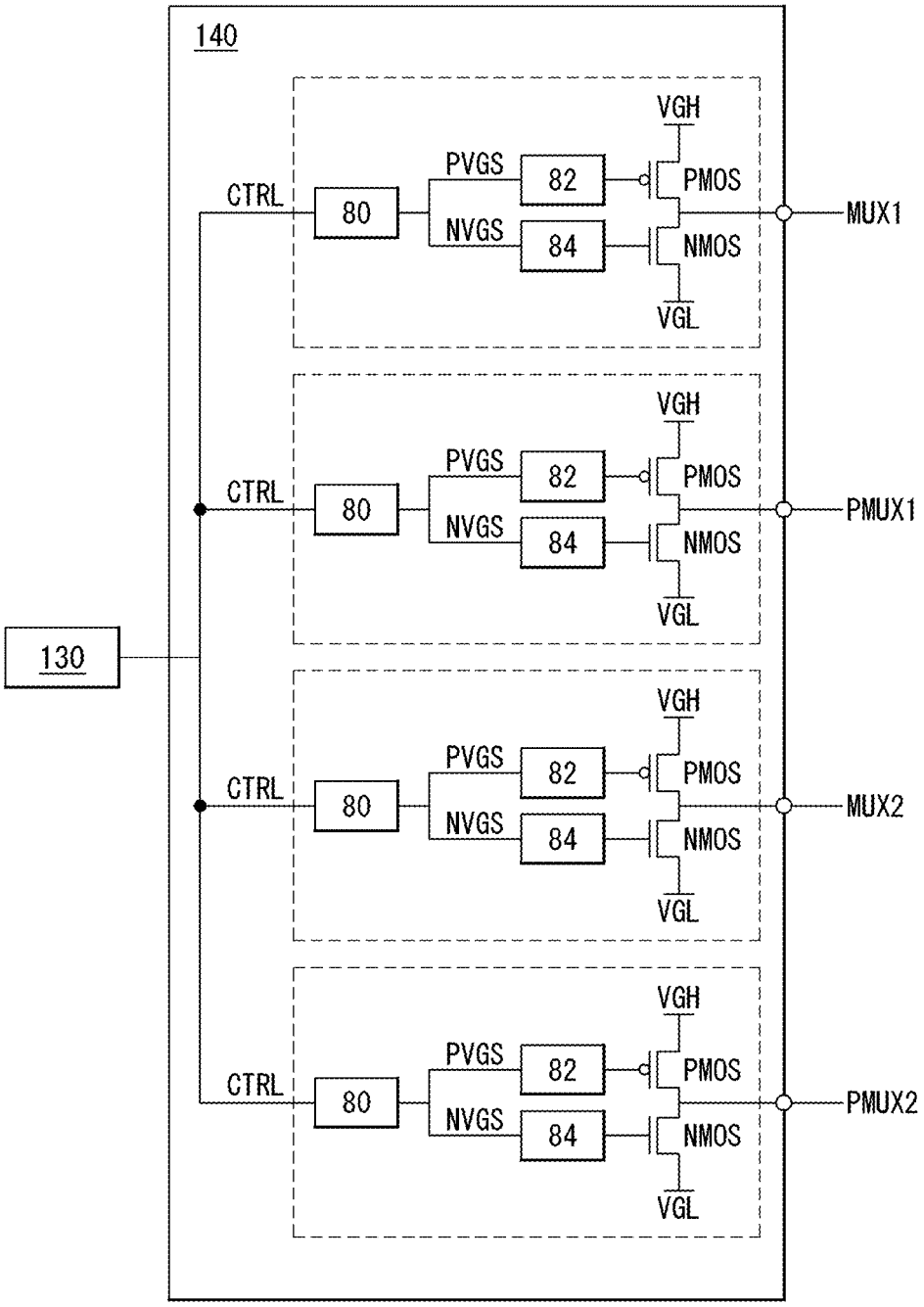
FIGS. 8 to 10 are diagrams illustrating a case in which MUX signals are output in pairs from the level shifter to improve electromagnetic interference (EMI)
Figure 9:
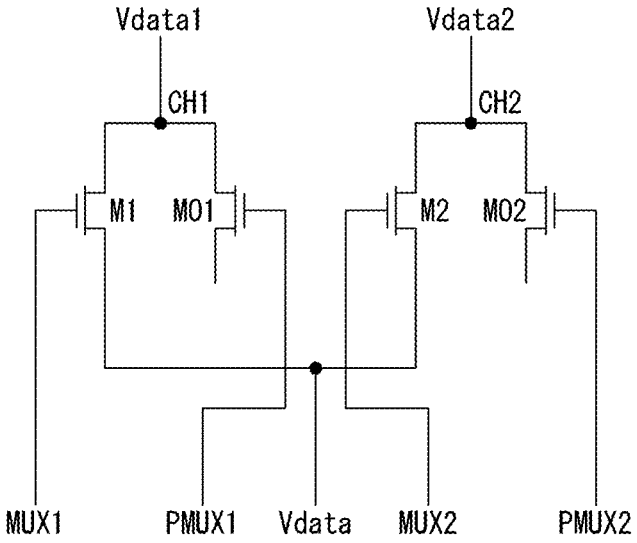
Figure 10:
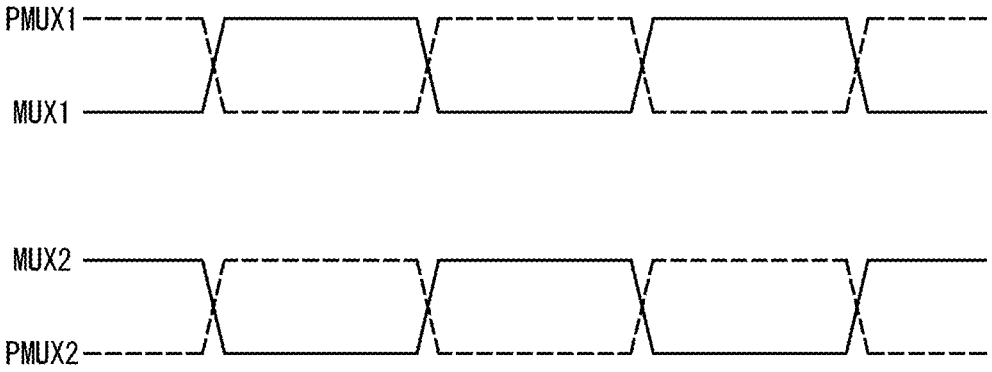

FIGS. 8 to 10 are diagrams illustrating a case in which MUX signals are output in pairs from the level shifter 140 to improve electromagnetic interference (EMI).

Referring to FIGS. 8 to 10, the level shifter 140 receives a control signal CTRL from the timing controller 130 and outputs MUX signals MUX1, PMUX1, MUX2, and PMUX2.

First MUX signal pair MUX1 and PMUX1 are generated as alternating current (AC) signals, which have opposite phases, and transmitted through neighboring lines. The first MUX signal pair MUX1 and PMUX1 include a first MUX signal MUX1 applied to a gate of the first switching element M1 of each of the demultiplexers 21 and 22 to control turning the first switching element M1 on and off and a first pseudo MUX signal PMUX1 that is not applied to the demultiplexers 21 and 22. The first pseudo MUX signal PMUX1 does not affect the output of the demultiplexers 21 and 22 but is a signal generated in the opposite phase of the first MUX signal MUX1 to cancel the current of the line through which the first MUX signal MUX1 is transmitted, thereby reducing EMI. The demultiplexers 21 and 22 may each further include a transistor M01 having a gate to which the first pseudo MUX signal PMUX1 is applied. A first electrode of the transistor M01 is connected to an output of the channel CH1 of the data driver 110 and a second electrode thereof is floated. Thus, the data signal Vdata is not applied to the transistor M01 to which the first pseudo MUX signal PMUX1 is applied.

Second MUX signal pair MUX2 and PMUX2 include a second MUX signal MUX2, which is applied to a gate of the second switching element M2 of each of the demultiplexers 21 and 22 to control turning the second switching element M2 on and off, and a second pseudo MUX signal PMUX2 that is not applied to the demultiplexers 21 and 22. The second pseudo MUX signal PMUX2 does not control the output of the demultiplexers 21 and 22 but is a signal generated in the opposite phase of the second MUX signal MUX2 to cancel the current of the line through which the second MUX signal MUX2 is transmitted, thereby reducing EMI.

The demultiplexers 21 and 22 may further include a transistor M02 having a gate to which the second pseudo MUX signal PMUX2 is applied. A first electrode of the transistor M02 is connected to an output of the channel CH2 of the data driver 110 and a second electrode thereof is floated. Accordingly, the data signal Vdata is not applied to the transistor M02 to which the second pseudo MUX signal PMUX2 is applied.

The pseudo MUX signals PMUX1 and PMUX2 are not applied to the demultiplexers 21 and 22 and thus do not affect the pixels. The pseudo MUX signals PMUX1 and PMUX2 serve to cancel EMI caused by a peak current at a rising and/or falling edge of the MUX signals MUX1 and MUX2.

In a high voltage period in which the pulses of the first and second MUX signals MUX1 and MUX2 are maintained at the gate-high voltage VGH, the voltage of the data signal Vdata is applied to the pixels through the data lines.

The level shifter 140 includes an output buffer (PMOS and NMOS) that shifts and outputs a voltage level of the control signal CTRL, first and second drivers 82 and 84, and a controller 80. The first and second drivers 82 and 84 may be simplified as a single driver.

An output node of the output buffer (PMOS and NMOS) is connected to each of the output terminals of the level shifter 140.

The output buffer (PMOS and NMOS) is formed in each of output channels of the level shifter 140. The output buffer (PMOS and NMOS) includes a first transistor (PMOS) in which a gate-source voltage Vgs is controlled by a first Vgs signal PVGS, and a second transistor (NMOS) in which a gate-source voltage Vgs is controlled by a second VGS signal NVGS.

The controller 80 generates the first and second Vgs signals PVGS and NVGS in response to the control signal CTRL from the timing controller 130 and provides the first and second Vgs signals PVGS and NVGS to the first and second drivers 82 and 84 to control the gate-source voltages Vgs of the first and second transistors (PMOS and NMOS).

The first driver 82 receives the first Vgs signal PVGS generated from the controller 80 and changes a gate voltage of the first transistor (PMOS) during the transition time of the output signal Vout. The second driver 84 receives the second Vgs signal NVGS generated from the controller 80 and changes a gate voltage of the second transistor (NMOS) during the transition time of the output signal Vout.

The first transistor (PMOS) may be implemented as a p-channel transistor. The first transistor (PMOS) is turned on when the gate voltage is lower than the gate-high voltage VGH by at least the threshold voltage Vth to supply the gate-high voltage VGH to the output node. When the first transistor (PMOS) is turned on, the output node is charged to increase the voltage of the output signal.

The second transistor (NMOS) is turned on when the gate voltage is higher than the gate-low voltage VGL by at least the threshold voltage Vth to supply the gate-low voltage VGL to the output node. When the second transistor (NMOS) is turned on, the output node is discharged to decrease the voltage of the output signal.

Accordingly, peak currents of neighboring lines are canceled at the transition time of the first MUX signal pair MUX1 and PMUX1 so that EMI may be reduced.

According to the present disclosure, in order to further reduce the EMI, a slew rate of the output signal of the level shifter 140 may be further reduced. To this end, according to the present disclosure, the voltage difference between the gate-source voltage Vgs of the transistors (PMOS and NMOS) and the threshold voltage Vth of the transistors (PMOS and NMOS) may be reduced. When the voltage difference between the gate-source voltage Vgs of the transistors (PMOS and NMOS) and the threshold voltage Vth of the transistors (PMOS and NMOS) is reduced, on-resistance of the transistors (PMOS and NMOS) increases to lower the slope of the waveform of the output signal so that the peak current value is lowered during the transition time of the output signal of the level shifter 140. For example, when the minimum voltage of the first Vgs signal PVGS increases, the on-resistance of the first transistor (PMOS) increases so that the slew rate of the output signal is lowered during the transition time during which the output signal rises. When the maximum voltage of the second Vgs signal NVGS decreases, the on-resistance of the second transistor (NMOS) increases so that the slew rate of the output signal is lowered during the transition time during which the output signal falls. When the transistor is turned on, the resistance between a drain and a source of the transistor is the resistance of the channel.

When the voltage difference between the gate-source voltage Vgs of the transistors (PMOS and NMOS) and the threshold voltage Vth of the transistors (PMOS and NMOS) is reduced, the output signal of the level shifter 140 may be sensitively affected by the variation in the threshold voltages Vth of the transistors (PMOS and NMOS). In this case, there is a difference in the slew rate between the rising edge and the falling edge of the output signal of the level shifter 140, which may cause a difference in the charging times of the pixels and thus the degradation in image quality may occur.

Figure 11:
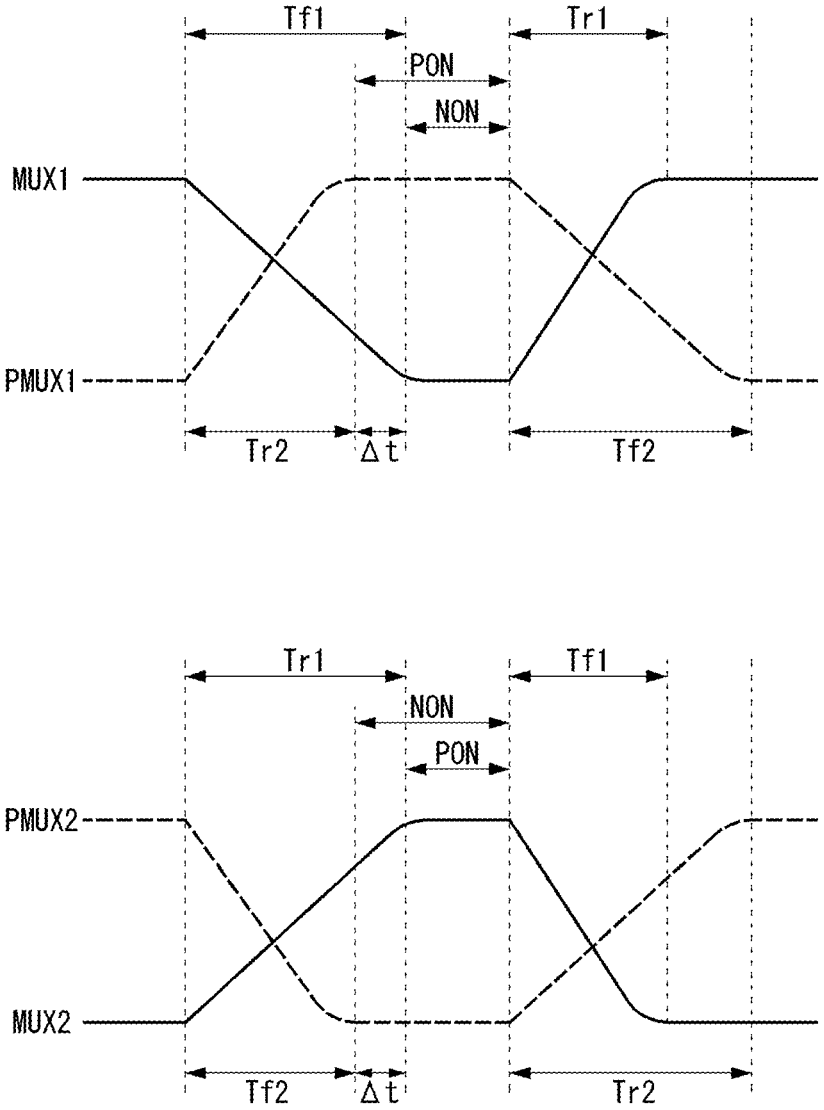
FIGS. 11 and 12 are diagrams illustrating a difference in rising and falling times of an output signal of the level shifter occurring due to the variation in threshold voltages of transistors.
Figure 12:
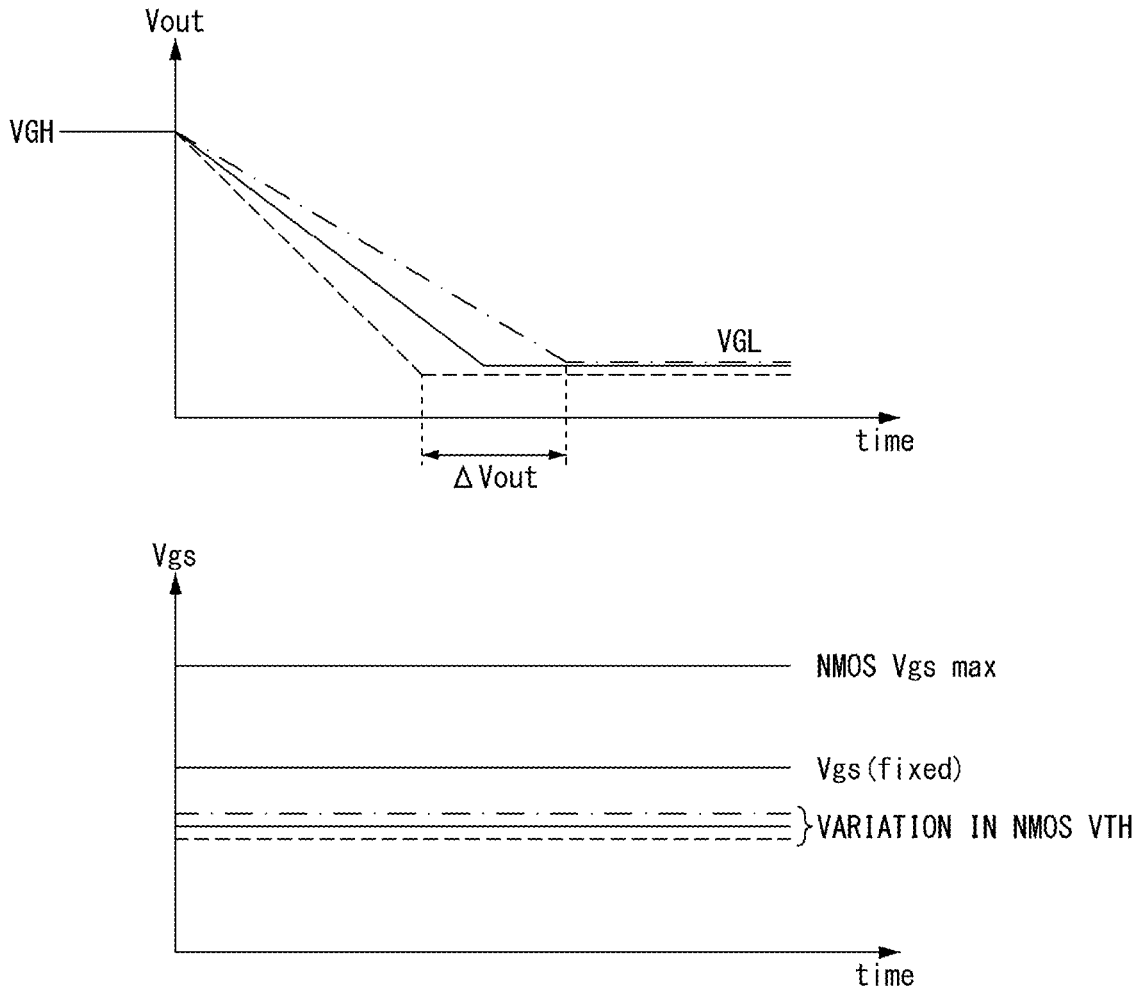

FIGS. 11 and 12 are diagrams illustrating a difference in rising and falling times of the output signal Vout of the level shifter 140 occurring due to the variation in the threshold voltages of the transistors (PMOS and NMOS).

Referring to FIGS. 11 and 12, Tf1 is a transition time of a falling edge of the MUX signal MUX1 or MUX2. Tr1 is a transition time of a rising edge of the MUX signal MUX1 or MUX2. Tf2 is a transition time of a falling edge of the pseudo MUX signal PMUX1 or PMUX2. Tr2 is a transition time of a rising edge of the pseudo MUX signal PMUX1 or PMUX2.

PON is on-time of the first transistor (PMOS). NON is on-time of the second transistor (NMOS). As shown in FIG. 12, there may be a variation in the threshold voltage Vth between the transistors (PMOS and NMOS). When the voltage of the second Vgs signal NVGS is lowered to be close to the threshold voltage Vth of the second transistor (NMOS) to lower the slew rate of the output signal at the falling edge of the output signal, the slew rate of the output signal Vout is lowered.

EMI may be minimized at the rising and falling edges of the MUX signals MUX1 and MUX2 when the waveforms of the MUX signals MUX1 and MUX2 and the waveforms of the pseudo MUX signals PMUX1 and PMUX2 are respectively opposite in phase and symmetrical to each other. However, as shown in FIG. 11, when the variation occurs in the slew rate between the MUX signals MUX1 and MUX2 and the pseudo MUX signals PMUX1 and PMUX2, the signals are not symmetrical to the signals having opposite phases and thus an EMI cancellation effect may be reduced.

Due to the variation in the threshold voltages Vth of the transistors, a time difference Δt until which the output signal Vout reaches a target voltage increases. Such a time difference Δt greatly increases the tolerance in implementing the level shifter circuit.

The target voltage at the rising edge of the output signal VOUT' may be the gate-high voltage VGH. The target voltage at the falling edge of the output signal VOUT' may be the gate-low voltage VGL. In this case, the time for which the data signal Vdata is applied to the data line may be reduced.

When the switching elements M1 and M2 of the demultiplexers 21 and 22 are implemented as p-channel transistors, the switching elements M1 and M2 are turned on during the time of NON as shown in FIG. 11, and the variation in the on-times of the switching elements M1 and M2 is increased due to the variation in the threshold voltage Vth of the transistor (NMOS) so that the on-time may be reduced. As a result, a difference may occur in the application time of the data signal applied to the data lines and the application time may be reduced so that the charging time may vary between the pixels and the charging time may be reduced.

Figure 13:
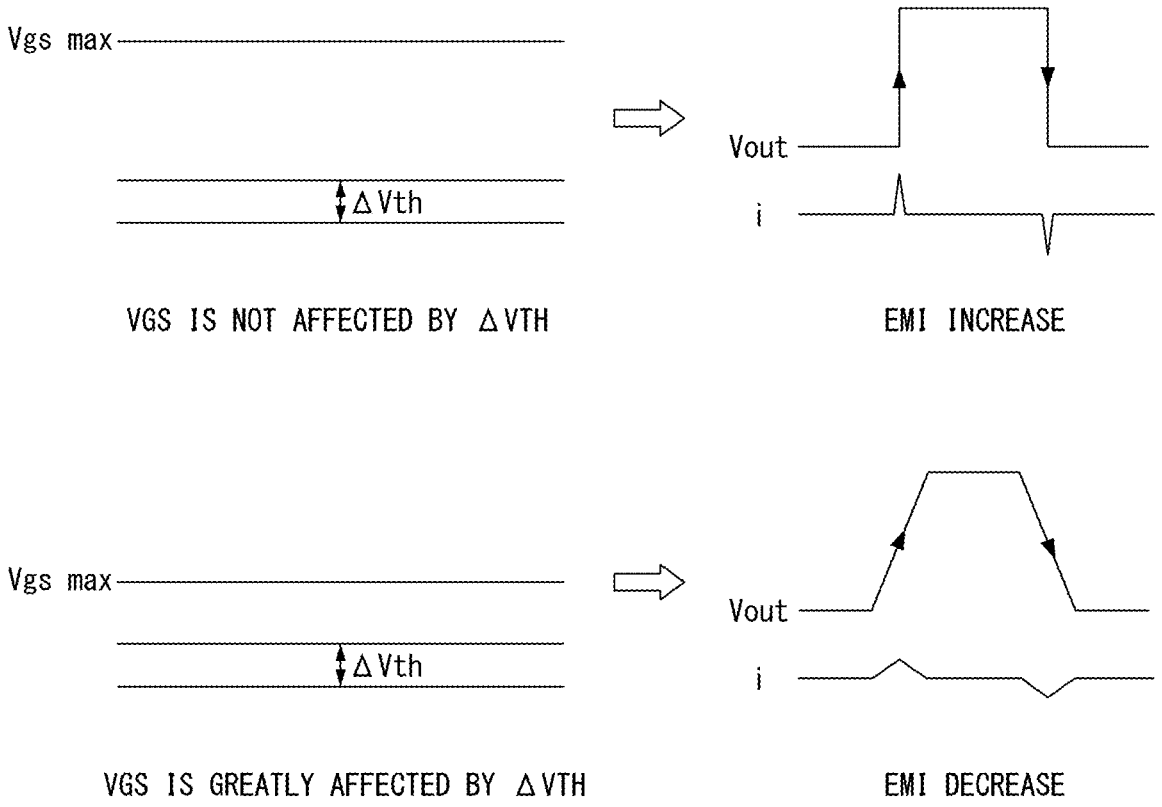
FIG. 13 is a waveform diagram illustrating changes in an output signal waveform and current of the level shifter according to a voltage difference between the threshold voltage and a gate-source voltage of the transistor.

FIG. 13 is a waveform diagram illustrating changes in an output signal waveform and current of the level shifter 140 according to the voltage difference between the threshold voltage Vth and the gate-source voltage Vgs of the transistor.

Referring to FIG. 13, when the voltage difference between the threshold voltage Vth and the gate-source voltage Vgs of the transistor increases, the on-resistance of the transistors (PMOS and NMOS) decreases so that the slew rate increases in the waveform of the output signal Vout and the peak current increases. When the voltage difference between the threshold voltage Vth and the gate-source voltage Vgs of the transistors (PMOS and NMOS) increases, the gate-source voltage Vgs of the transistors (PMOS and NMOS) is hardly affected by a threshold voltage variation ΔVth of the transistors (PMOS and NMOS).

In contrast, when the voltage difference between the threshold voltage Vth and the gate-source voltage Vgs of the transistor is reduced, the on-resistance of the transistors (PMOS and NMOS) increases so that the slew rate is reduced in the waveform of the output signal Vout and the peak current is reduced. When the voltage difference between the threshold voltage Vth and the gate-source voltage Vgs of the transistors (PMOS and NMOS) is reduced, the gate-source voltage Vgs of the transistors (PMOS and NMOS) may be greatly influenced by the threshold voltage variation ΔVth of the transistors (PMOS and NMOS) and thus may vary according to the variation in the threshold voltages Vth of the transistors (PMOS and NMOS).

Figure 14:
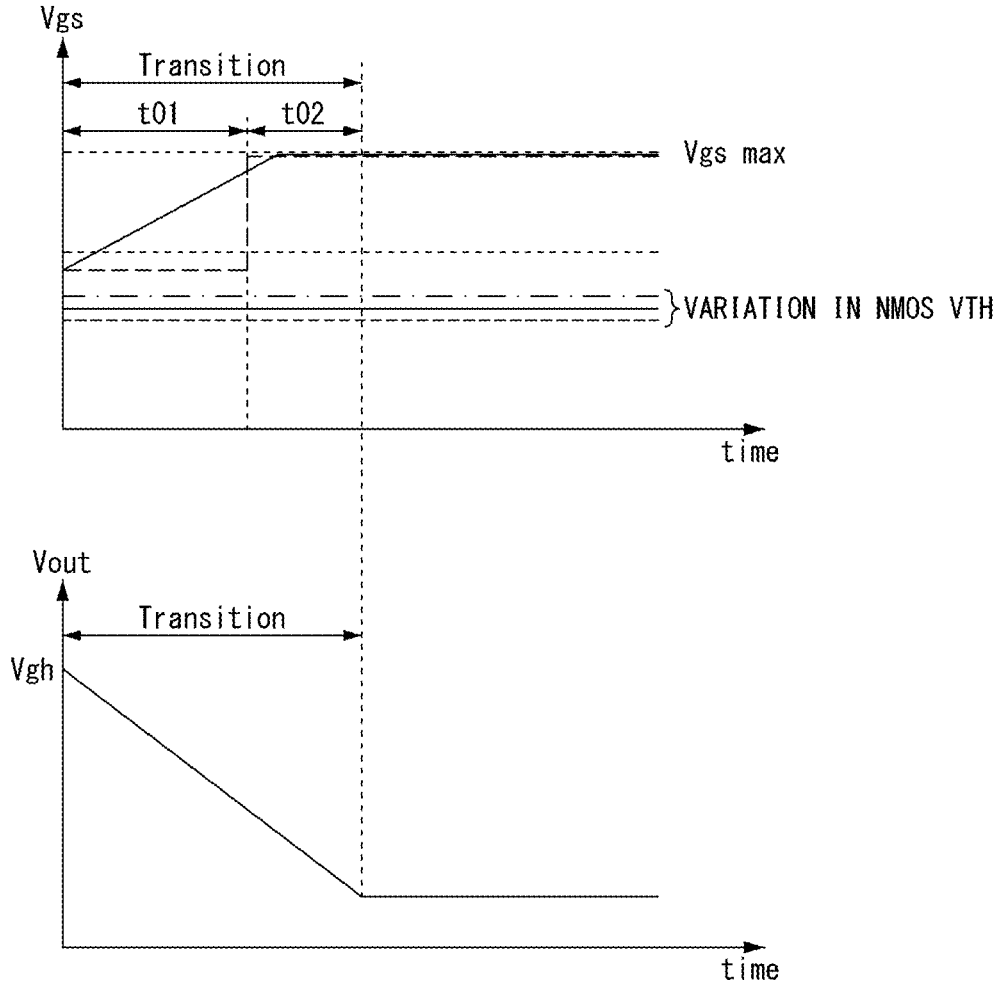
FIGS. 14 and 15 are waveform diagrams illustrating a method of controlling the gate-source voltage to reduce the variation in a transition time of the output signal of the level shifter.
Figure 15:
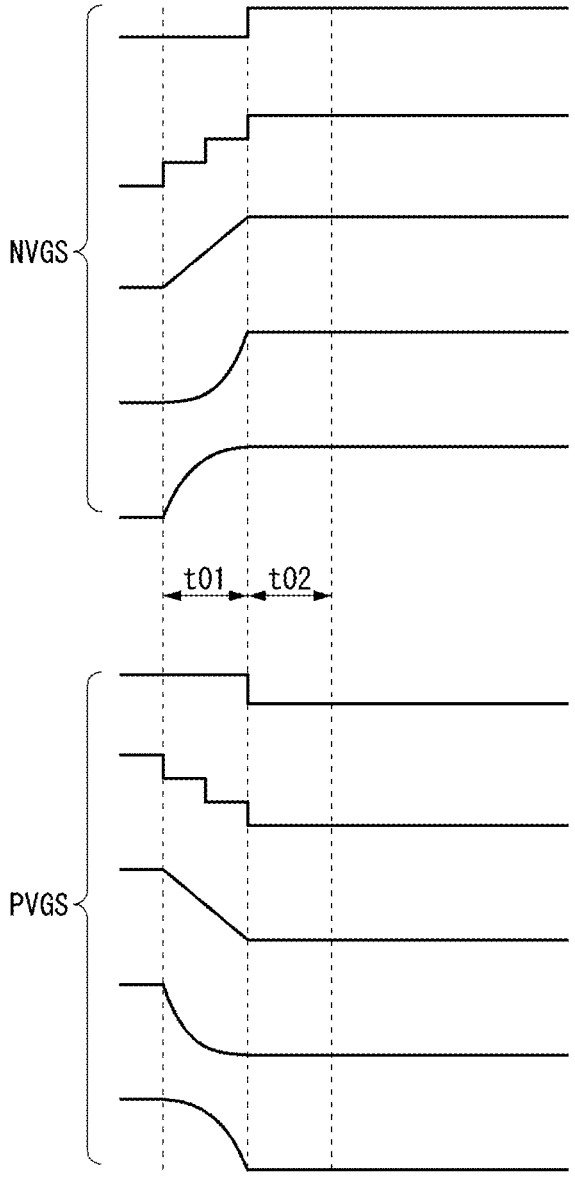

FIGS. 14 and 15 are waveform diagrams illustrating a method of controlling the gate-source voltage Vgs to reduce the variation in the transition time of the output signal of the level shifter.

Referring to FIGS. 14 and 15, in the present disclosure, the transition time of the output signal Vout is divided into at least two periods t01 and t02, and the gate-source voltage Vgs of at least one of the transistors (PMOS and NMOS) is varied during the transition time. For example, the gate-source voltage Vgs of the second transistor (NMOS) among the first and second transistors (PMOS and NMOS) may be varied within the transition time. The gate-source voltage Vgs of the first and second transistors (PMOS and NMOS) may be varied within the transition time.

The transition time of the output signal Vout may be divided into a first period t01 and a second period t02.

According to the present disclosure, the on-resistance of the transistors (PMOS and NMOS) is controlled to be great in the first period t01 and then the on-resistance of the transistors (PMOS and NMOS) is controlled to be low in the second period t02 by varying the Vgs signals PVGS and NVGS, which control the gate voltages of the transistors (PMOS and NMOS), during the transition time.

In the first period t01, the voltage difference between the gate-source voltage Vgs of the transistors (PMOS and NMOS) and the threshold voltage Vth of the transistors (PMOS and NMOS) is reduced so that the on-resistance of the transistors (PMOS and NMOS) is increased. The slew rate of the output signal Vout is lowered in the first period t01 in which the on-resistance of the transistors (PMOS and NMOS) is great, and thus EMI is improved.

In the second period t02, the voltage difference between the gate-source voltage Vgs of the transistors (PMOS and NMOS) and the threshold voltage Vth of the transistors (PMOS and NMOS) is relatively increased so that the on-resistance of the transistors (PMOS and NMOS) is reduced. Since the gate-source voltage Vgs of the transistors (PMOS and NMOS) is not affected by the threshold voltage variation ΔVth of the transistors (PMOS and NMOS) in the second period t02 in which the on-resistance of the transistors (PMOS and NMOS) is low, the time difference required to reach the target voltage at the rising and falling edges of the output signal Vout may be reduced. As a result, the tolerance of the level shifter circuit may be reduced. According to the present disclosure, EMI on the lines through which the output signal of the level shifter 140 is transmitted may be reduced, and the influence of the threshold voltage variation of the transistor may be reduced so that the tolerance of the level shifter 140 may be reduced and the degradation in image quality may be prevented.

As shown in FIG. 15, the first and second Vgs signals PVGS and NVGS may have voltages being varied in a step waveform, a linear ramp waveform, a curve waveform, and the like at the transition time of the output signal Vout in consideration of the characteristics of the display panel 100 and the analog circuit characteristics of the level shifter 140.

Figure 16:
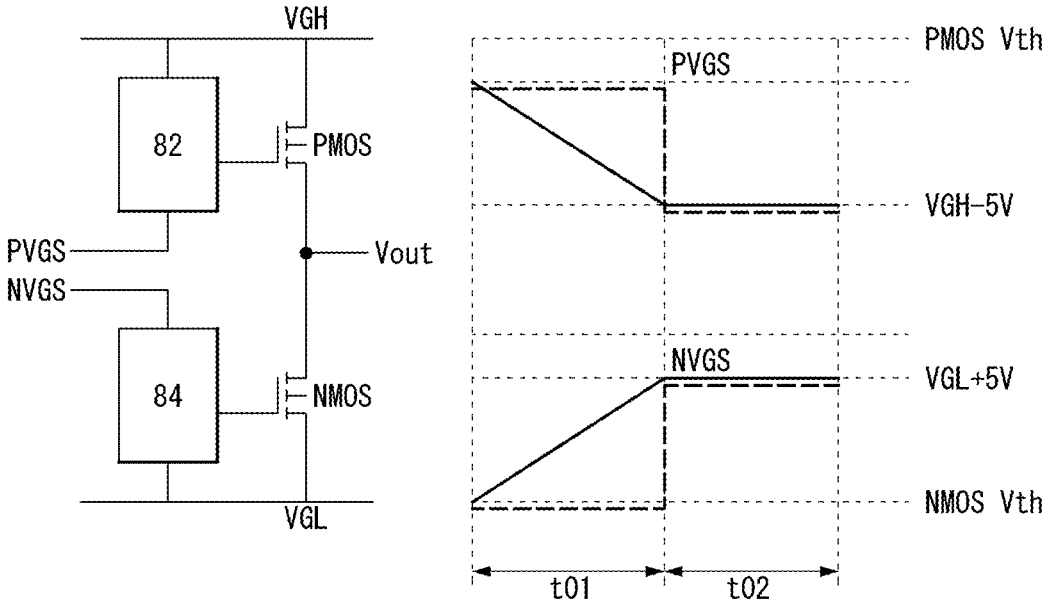
FIG. 16 is a view illustrating Vgs signals that control the gate-source voltages of the transistors at the transition times of the output signal of the level shifter.

FIG. 16 is a view illustrating the Vgs signals PVGS and NVGS that control the gate-source voltages Vgs of the transistors (PMOS and NMOS) at the transition time of the output signal Vout.

Referring to FIG. 16, when the second Vgs signal NVGS is varied within the transition time of the output signal Vout, the on-resistance of the second transistor (NMOS) is greater in the first period t01 than in the second period t02. The voltage difference between the voltage of the second Vgs signal NVGS and a threshold voltage NMOS Vth of the second transistor (NMOS) is greater in the second period t02 than in the first period t01. The voltage of the second Vgs signal NVGS is smaller in the first period t01 than in the second period t02. The second Vgs signal NVGS may rise from a voltage higher than the threshold voltage NMOS Vth of the second transistor (NMOS) when the transition time starts and reach a target voltage VGL+5V.

When both the first and second Vgs signals PVGS and NVGS are varied within the transition time of the output signal Vout, the on-resistance of each of the first and second transistors (PMOS and NMOS) is greater in the first period t01 than in the second period t02. The voltage difference between the voltage of first Vgs signal PVGS and a threshold voltage PMOS Vth of the first transistor (PMOS) is greater in the second period t02 than in the first period t01. Similarly, the voltage difference between the voltage of the second Vgs signal NVGS and the threshold voltage NMOS Vth of the second transistor (NMOS) is greater in the second period t02 than in the first period t01. The voltage of the first Vgs signal PVGS is greater in the first period t01 than in the second period t02. The voltage of the second Vgs signal NVGS is smaller in the first period t01 than in the second period t02. The first Vgs signal PVGS may fall from a voltage lower than the threshold voltage PMOS Vth of the first transistor (PMOS) when the transition time starts and reach a target voltage VGL−5V. The second Vgs signal NVGS may rise from a voltage higher than the threshold voltage NMOS Vth of the second transistor (NMOS) when the transition time starts and reach a target voltage VGL+5V.

Figure 17:
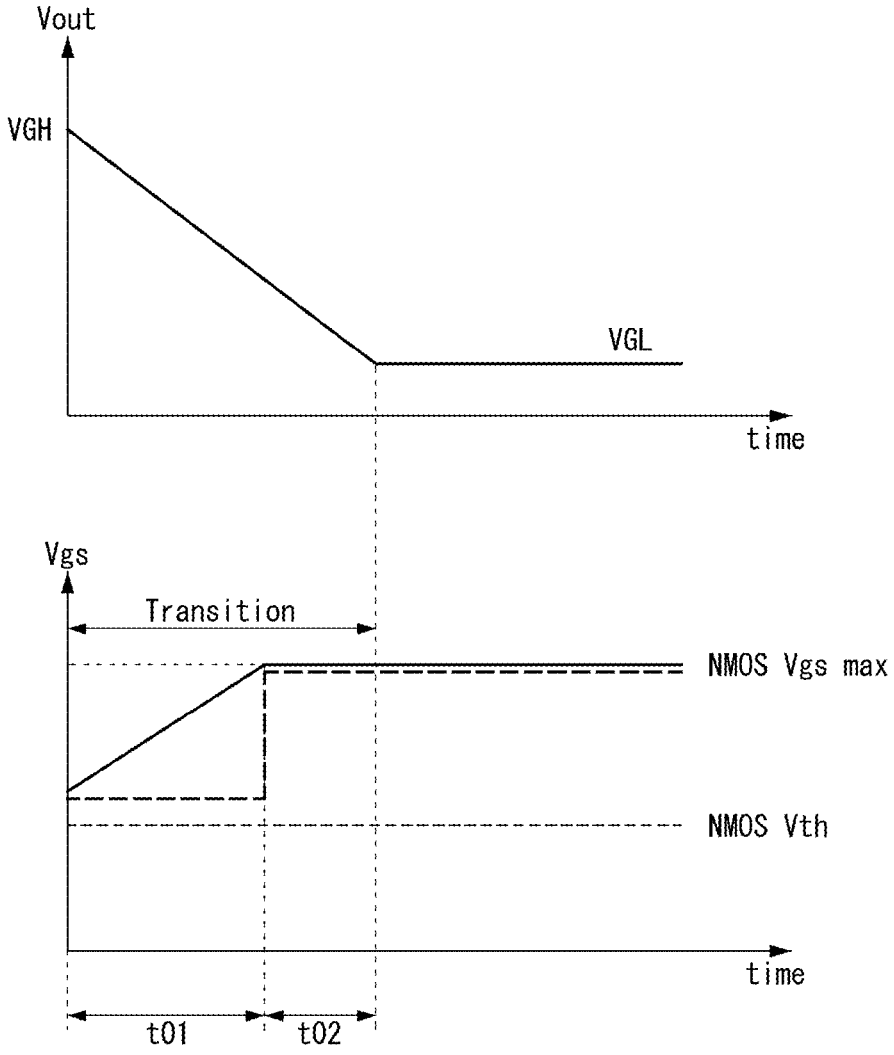
FIG. 17 is a set of waveform diagrams each illustrating a second Vgs signal and the output signal that are varied in the transition time.

FIG. 17 is a set of waveform diagrams each illustrating the second Vgs signal NVGS and the output signal Vout that are varied in the transition time. In FIG. 17, the upper side graph shows the change in the voltage of the output signal Vout when the second Vgs signal NVGS changes as shown in the lower side graph at the falling edge transition time of the output signal.

Referring to FIG. 17, the voltage of the second Vgs signal NVGS increases gradually or in a stepwise manner within the transition time of the falling edge. In the first period t01 of the transition time of the falling edge, the voltage of the output signal Vout of the level shifter 140 starts to decrease by the second Vgs signal NVGS being varied and reaches a target voltage VGL in the transition time at a low slew rate. In addition, in the second period t02, the voltage difference between the voltage of the second Vgs signal NVGS and the threshold voltage Vth of the transistor (NMOS) increases, and thus the voltage of the output signal Vout of the level shifter 140 reaches the target voltage VGL without being affected by the threshold voltage variation ΔVth of the second transistor (NMOS).

Figure 18:
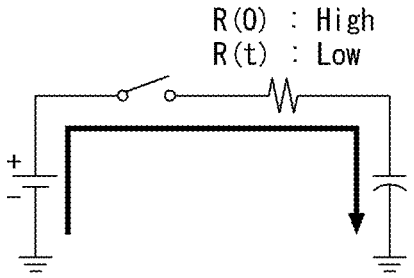
FIG. 18 is a circuit diagram modeling an on-resistance variation of the transistor in accordance with the Vgs signal varied in the transition time.

FIG. 18 is a circuit diagram modeling an on-resistance variation of the transistor in accordance with the Vgs signal varied in the transition time.

Referring to FIG. 18, according to the present disclosure, the on-resistance of the transistors (PMOS and NMOS) is controlled to be great at the beginning (R(0):High) of the transition time using the Vgs signals PVGS and NVGS that control the gate-source voltages Vgs of the transistors (PMOS and NMOS). When on-current flows through the transistors (PMOS and NMOS) according to the voltage of the Vgs signals PVGS and NVGS, the on-resistance of the transistors (PMOS and NMOS) increases when the voltage difference between the voltage of the Vgs signals PVGS and NVGS and the threshold voltage Vth of the transistors (PMOS and NMOS) is small. When the on-resistance of the transistors (PMOS and NMOS) increases, the peak current in the line to which the output signal Vout is applied decreases.

Next, the voltage difference between the voltage of the Vgs signals PVGS and NVGS and the threshold voltage Vth of the transistors (PMOS and NMOS) increases after a predetermined time passes [R(t):Low] from the start time point of the transition time. At this time, the on-resistance of the transistors (PMOS and NMOS) decreases.

When the voltage difference between the voltage of the Vgs signals PVGS and NVGS and the threshold voltage Vth of the transistors (PMOS and NMOS) increases, the threshold voltage variation ΔVth of the transistors (PMOS and NMOS) is not affected in the output buffers of the level shifter 140. Due to this, the slew rate distribution of the output signals Vout output from the output terminals of the level shifter 140 may be minimized so that the voltages of the output signals VOUT may reach the target voltage at the same time.

Figure 19:
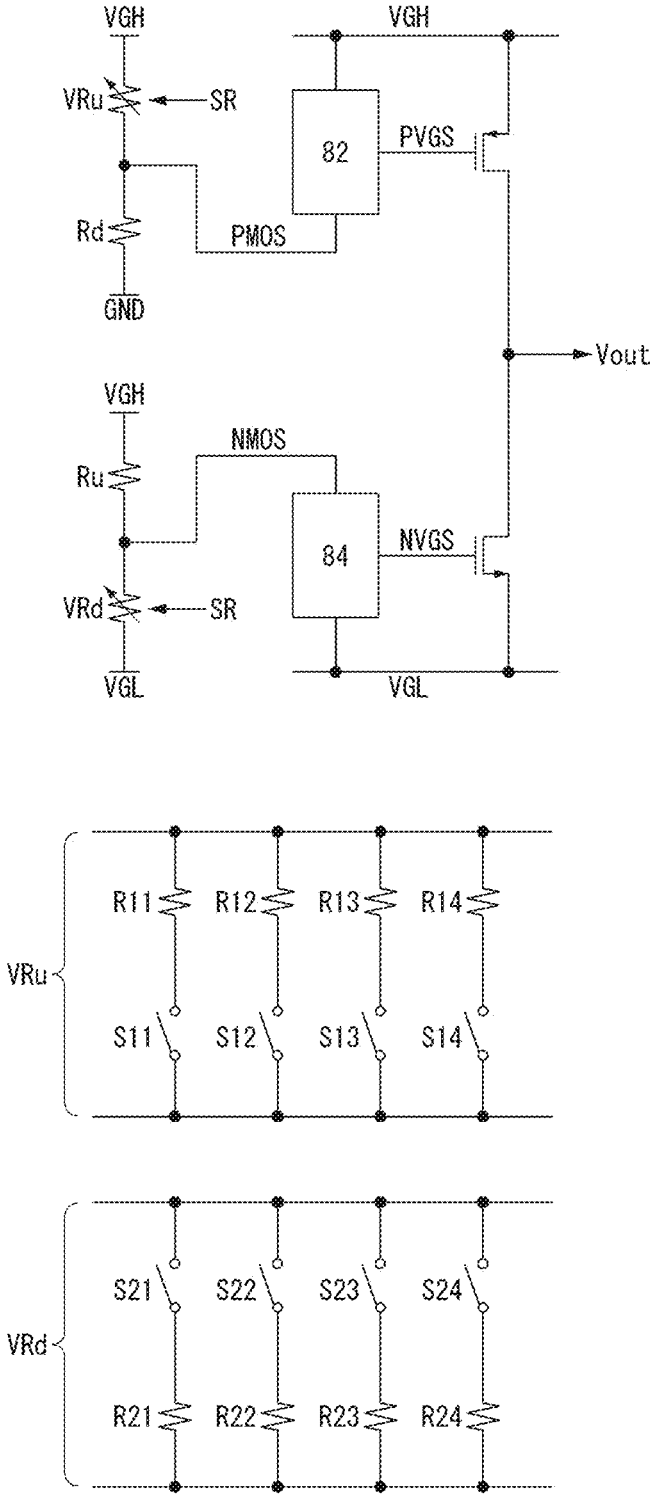
FIG. 19 is a circuit diagram illustrating an example of the level shifter in detail.

FIG. 19 is a circuit diagram illustrating an example of the level shifter 140 in detail. The level shifter 140 shown in FIG. 19 may output the output signal Vout having little peak current.

Referring to FIG. 19, the controller 80 includes a first signal generator configured to vary the voltage of the first Vgs signal PVGS and a second signal generator configured to vary the voltage of the second Vgs signal NVGS.

The first signal generator may include a voltage dividing circuit including a first variable resistor VRu and a resistor Rd that are connected between VGH and GND. The resistance value of the first variable resistor VRu may be varied under the control of the timing controller 130. The first variable resistor VRu may include resistors R11 to R14 having different resistance values and connected in parallel to VGH and switching elements S11 to S14 that respectively connect the resistors R11 to R14 to an output node of the voltage dividing circuit under the control of the timing controller 130. The switching elements S11 to S14 may be turned on or off according to a logic value of a bit in the control signal CTRL input from the timing controller 130 to select the output node voltage of the voltage dividing circuit, thereby varying the voltage of the first Vgs signal PVGS.

The first driver 82 varies the gate voltage of the first transistor (PMOS) according to the first Vgs signal PVGS from the first signal generator. For example, the first driver 82 lowers the gate voltage of the first transistor (PMOS) when the voltage of the first Vgs signal PVGS is lowered at the transition time of the output signal Vout.

The second signal generator may include a voltage dividing circuit including a second variable resistor VRd and a resistor Ru that are connected between VGH and VGL. The resistance value of the second variable resistor VRd may be varied under the control of the timing controller 130. The second variable resistor VRd may include resistors R21 to R24 having different resistance values and connected in parallel to VGL and switching elements S21 to S24 that respectively connect the resistors R21 to R24 to an output node of the voltage dividing circuit under the control of the timing controller 130. The switching elements S21 to S24 may be turned on or off according to a logic value of a bit in the control signal CTRL input from the timing controller 130 to select the output node voltage of the voltage dividing circuit, thereby varying the voltage of the second Vgs signal NVGS.

The second driver 84 varies the gate voltage of the second transistor (NMOS) according to the second Vgs signal NVGS from the second signal generator. For example, the second driver 84 increases the gate voltage of the second transistor (NMOS) when the voltage of the second Vgs signal NVGS is increased at the transition time of the output signal Vout.

Figure 20:
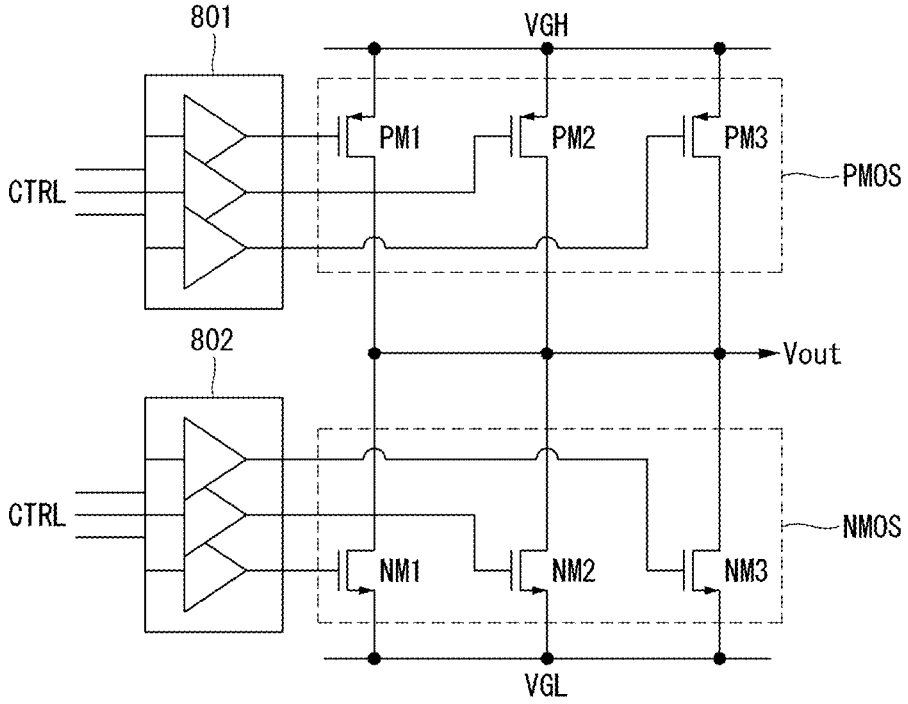
FIG. 20 is a circuit diagram illustrating another example of the level shifter in detail.

FIG. 20 is a circuit diagram illustrating another example of the level shifter 140 in detail. In the level shifter 140 shown in FIG. 20, a threshold voltage variation of transistors PM1 to PM3 and NM1 to NM3 is not high.

Figure 21:
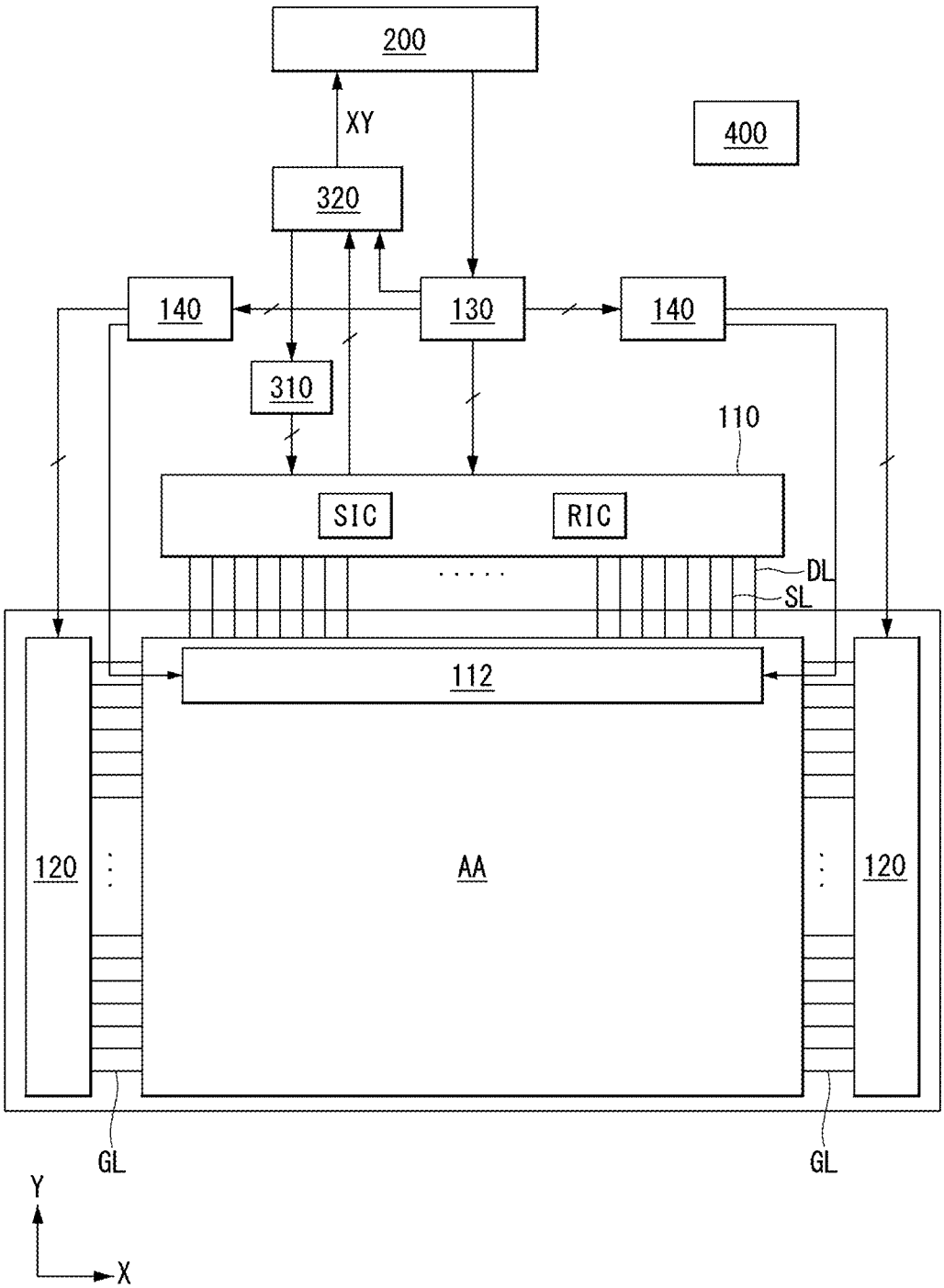
FIGS. 21 to 23 are diagrams illustrating an example of a display device having touch sensors.

Referring to FIG. 21, the level shifter 140 includes a plurality of first transistors PM1 to PM3 having different channel resistance values, a plurality of second transistors NM1 to NM3 having different channel resistance values, a first controller 801 configured to control turning the first transistors PM1 to PM3 on or off in response to the control signal CTRL, and a second controller 802 configured to control turning the second transistors NM1 to NM3 on or off in response to the control signal CTRL.

When the sum of the channel resistance values of the first transistors PM1 to PM3 is 100%, the channel resistance value of a (1-1)th transistor PM1 may be 80%, the channel resistance value of a (1-2)th transistor PM2 may be 10%, and the channel resistance value of a (1-3)th transistor PM3 may be 10%. The first controller 801 may select one or more among the first transistors PM1 to PM3, which are turned on in response to the control signal CTRL, to select on-resistance of the first transistors PM1 to PM3 connected to the output terminal of the level shifter 140. When the on-resistance of the first transistors PM1 to PM3 increases, the slew rate of the output signal Vout may be lowered.

When the sum of the channel resistance values of the second transistors NM1 to NM3 is 100%, the channel resistance value of a (2-1)th transistor NM1 may be 80%, the channel resistance value of a (2-2)th transistor NM2 may be 10%, and the channel resistance value of a (2-3)th transistor NM3 may be 10%. The second controller 802 may select one or more among the second transistors NM1 to NM3, which are turned on in response to the control signal CTRL, to select on-resistance of the second transistors NM1 to NM3 connected to the output terminal of the level shifter 140. When the on-resistance of the second transistors NM1 to NM3 increases, the slew rate of the output signal Vout may be lowered.

The above-described method of controlling the gate-source voltage Vgs of the transistor may be applied to the output buffer that outputs the gate timing signals such as the gate start pulse VST and the shift clock GCLK in the level shifter. In addition, the method of controlling the gate-source voltage Vgs of the transistor may be applied to a slew rate adjustment circuit in the power supply 400 and the touch sensor driver.

FIGS. 21 to 26 illustrate a display device to which an in-cell type touch sensor is applied. FIG. 27 is a circuit diagram illustrating a part of the power supply 400.

Figure 22:
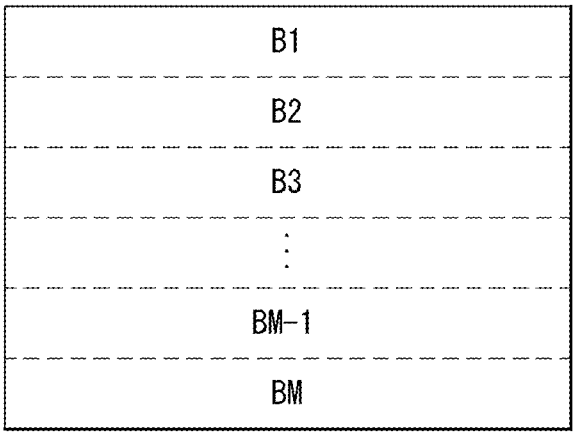
Figure 23:
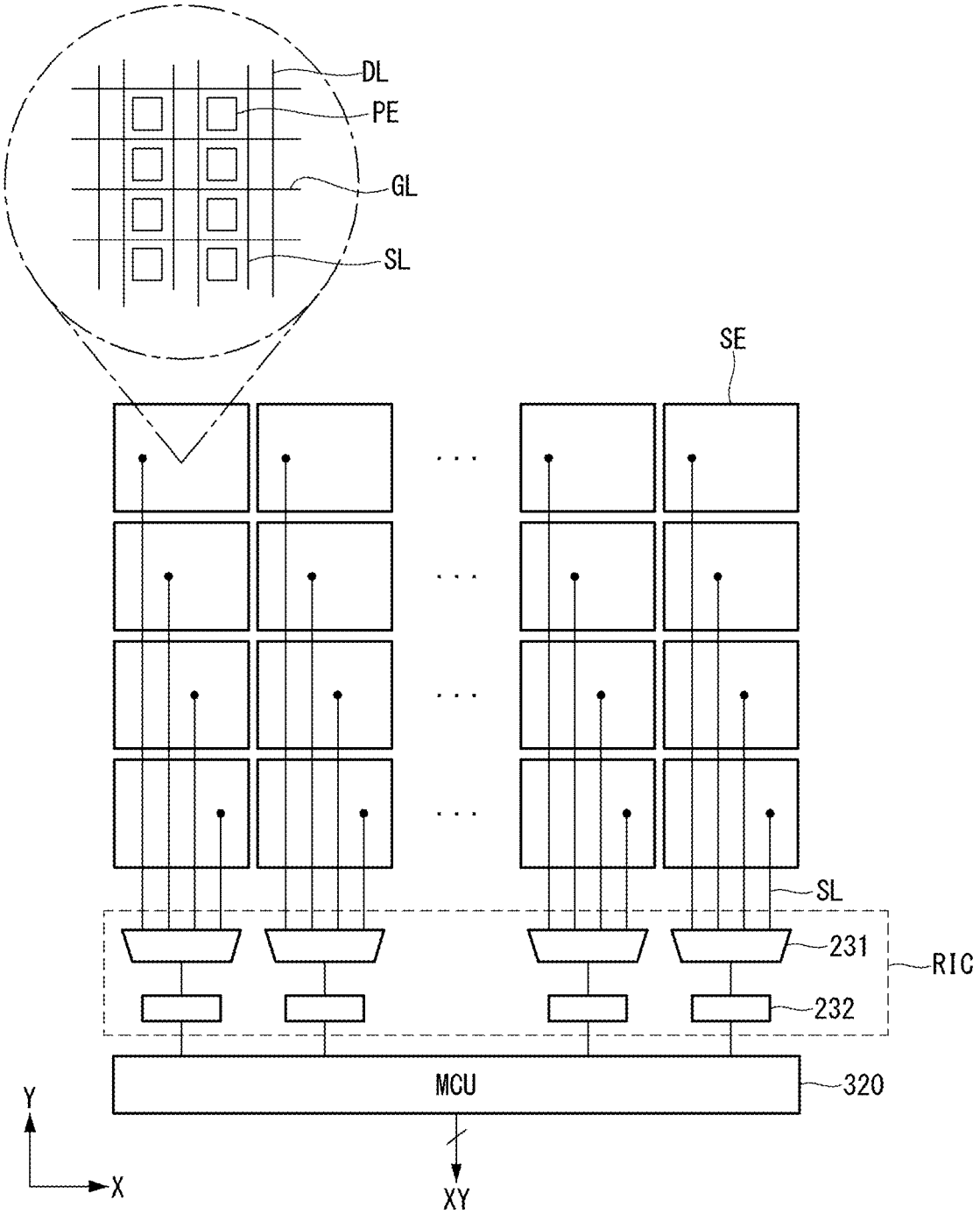

Referring to FIGS. 21 to 23, a touch screen may be disposed on a screen of the display panel 100. The touch screen includes a plurality of touch sensors disposed on the screen and a touch sensor driver configured to drive the touch sensors. The touch sensor driver may be integrated in a single IC together with a data driver. Hereinafter, "SRIC" refers to a driver IC in which the data driver and the touch sensor driver are integrated.

The display device of the present disclosure further includes an SRIC 110, a touch sensor controller 320, a parasitic capacitance controller 310, and the like.

The pixel array AA further includes touch sensors SE and sensor lines SL connected to the touch sensors SE, as shown in FIG. 23. Electrode patterns of each of the touch sensors SE may be formed in a pattern in which a common electrode of the pixels is divided into a predetermined size. The common electrode is an electrode that is connected to a plurality of pixels and applies the same common voltage to the pixels. One touch sensor SE is connected to a plurality of sub-pixels, and thus, during a display period, supplies a common voltage to the plurality of pixels and, during a touch sensing period, is driven by a touch sensor driver RIC and senses touch input. Accordingly, the touch sensors SE are common electrodes that supply a common voltage to the pixels during a display period, and, at the same time, sensor electrodes that sense touch input during a touch sensing period. In FIG. 23, "PE" denotes pixel electrodes respectively formed in the sub-pixels.

One frame period of the display panel 100 is time-divided into one or more display periods and one or more touch sensing periods. As shown in FIG. 22, the pixel array AA of the display panel 100 is divided into two or more blocks B1 to BM and is time-divisionally driven in units of blocks. Pixels belonging to one block may be driven for each display period. The blocks B1 to BM are divided driving regions that do not need to be physically separated on the display panel 100 and have driving timing which is divided under the control of the timing controller 130. Since the pixel array AA is driven during display periods, the pixel array AA is divided and driven at different timings with touch sensing periods in between. The pixels of the pixel array AA are not driven during the touch sensing periods but remain in the previous state.

The pixels in the blocks B1 to BM are time-divisionally driven with touch sensing periods in between. For example, pixels in a first block B1 are driven during a first display period to write current frame data to the pixels, and then touch input is sensed on the entire screen during a first touch sensing period. Following the first touch sensing period, pixels in a second block B2 are driven during a second display period to write current frame data to the pixels. Then, touch input is sensed on the entire screen during a second touch sensing period. Here, the touch input includes direct touch input, proximity touch input, fingerprint touch input, or the like of a finger or stylus pen.

The touch sensor SE may be implemented as a capacitance-type touch sensor, for example, a mutual capacitance sensor or a self-capacitance sensor. Self-capacitance is formed along a single layer of a conductor line formed in one direction. Mutual capacitance is formed between two conductor lines intersecting each other. Although FIG. 23 illustrates a self-capacitance type touch sensor, the touch sensors of the present disclosure are not limited thereto. The touch sensors SE are connected to the SRIC 110 through the sensor lines SL.

The SRIC 110 includes a data driver SIC configured to supply a data voltage of an input image to the data lines DL during a display period and the touch sensor driver RIC that is connected to the touch sensors SE through the sensor lines SL and drives the touch sensors during a touch sensing period.

As described above, the data driver SIC inputs the pixel data received from the timing controller 130 to the DAC and outputs the data signal Vdata. During a touch sensing period, the touch sensor driver RIC supplies a load free signal LFD to the sensor lines SL in response to a touch sensor driving signal received from the touch sensor controller 320 to supply an electric charge to the touch sensors SE, thereby driving the touch sensors SE.

As shown in FIG. 23, the touch sensor driver RIC includes multiplexers 231 and sensing circuits 232. The multiplexers 231 select the sensor lines SL to be connected to the sensing circuits 232 under the control of the touch sensor controller 320. The multiplexers 231 may supply a common voltage Vcom during a display period under the control of the touch sensor controller 320. The multiplexers 231 sequentially connect the sensor lines SL to the channels of the sensing circuits 232 during a touch sensing period, thereby reducing the number of channels in the sensing circuits 232.

The sensing circuits 232 charge the touch sensors SE with an electric charge by supplying the load free signal LFD from the parasitic capacitance controller 310 to the touch sensors SE through the multiplexers 231 and the sensor lines SL during a touch sensing period. The sensing circuits 232 amplify and integrate the amount of charge in the touch sensors SE received from the sensor lines SL connected through the multiplexers 231, convert the integrated value into digital data, and sense changes in capacitance before and after touch input. To this end, the sensing circuits 232 each include an amplifier configured to amplify a touch sensor signal received from the touch sensor SE, an integrator configured to accumulate the output voltage of the amplifier, and an analog-to-digital converter (hereinafter, referred to as an "ADC") configured to convert the voltage of the integrator into digital data. The digital data output from the ADC is touch data that indicates changes in the capacitance of the touch sensors SE before and after touch input, which is transmitted to the touch sensor controller 320. The sensing circuits 232 may sequentially drive the touch sensors SE in units of a touch sensor group of a predetermined size under the control of the touch sensor controller 320. The touch sensor group includes a plurality of touch sensors SE.

The touch sensor controller 320 generates coordinates XY of each touch input by comparing the touch data received from the touch sensor driver RIC with a preset threshold value and detecting touch data having a value higher than the threshold value. The touch sensor controller 320 transmits the coordinates XY of each touch input to the host system 200. The touch sensor controller 320 outputs a touch enable signal, an ADC clock, or the like that defines touch sensor driving timing and supplies it to the touch sensor driver RIC. The touch sensor controller 320 may be implemented as a micro control unit (MCU), but the present disclosure is not limited thereto.

The parasitic capacitance controller 310 improves a signal-to-noise ratio (hereinafter referred to as "SNR") of a touch sensor signal by minimizing the parasitic capacitance between the touch sensors SE and the pixels during a touch sensing period. To this end, the parasitic capacitance controller 310 generates a load free signal LFD and supplies the load free signal LFD to the touch sensor driver RIC in response to the touch sensor driving signal from the touch sensor controller 320. The load free signal LFD is applied to the data lines DL, the gate lines GL, and the sensor lines SL.

The load free signal LFD applied to the sensor lines SL is a touch sensor driving signal that supplies an electric charge to the touch sensors SE and minimizes the parasitic capacitance between neighboring sensor lines SL.

As described above, the gate driver 120 includes the shift register that outputs the gate pulse in response to the gate timing control signal inputted through the level shifter 140. The shift register may be formed directly on a substrate of the display panel 100 together with a TFT array of the pixel array and in the same process. The gate driver 120 sequentially supplies a gate pulse to the gate lines GL using the shift register.

The power supply 400 generates DC voltage required to drive the display panel 100 using a DC-DC converter as described above.

Figure 24:
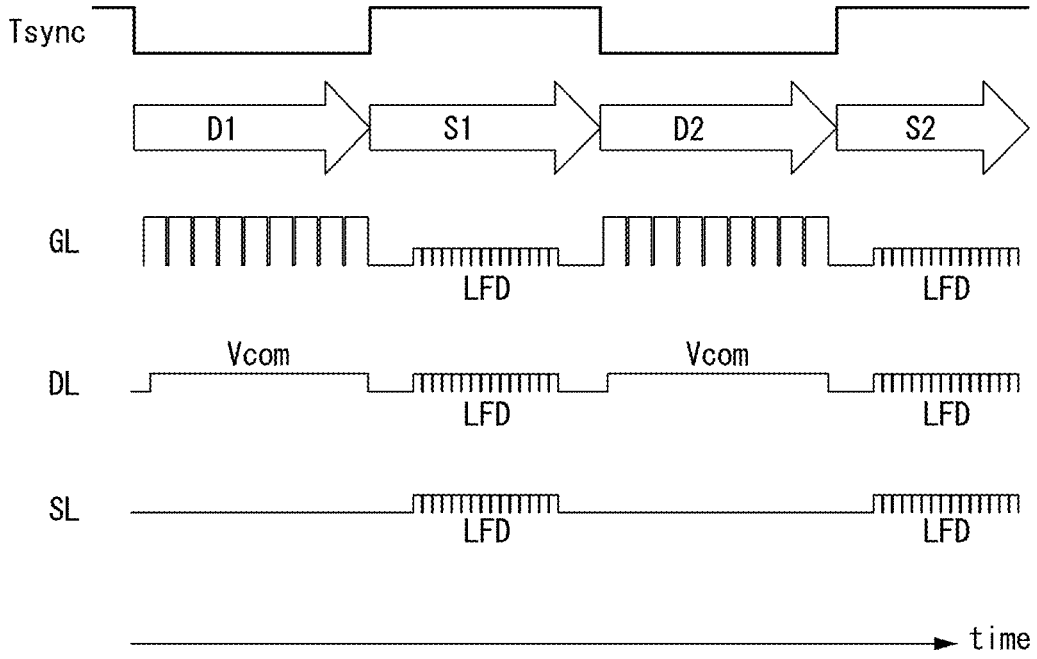
FIGS. 24 and 25 are waveform diagrams illustrating a method of driving pixels and the touch sensors.

The timing controller 130 transmits pixel data of an input image received from the host system 200 to the data driver SIC of the SRIC 110. As shown in FIG. 24, the timing controller 130 generates a synchronization signal Tsync for synchronizing the SRIC 110 and the gate driver 120. As shown in FIG. 24, a high level of the synchronization signal Tsync may define a touch sensing period, and a low level of the synchronization signal Tsync may define a display period, but the present disclosure is not limited thereto. The synchronization signal Tsync is supplied to the touch sensor controller 320.

Figure 25:
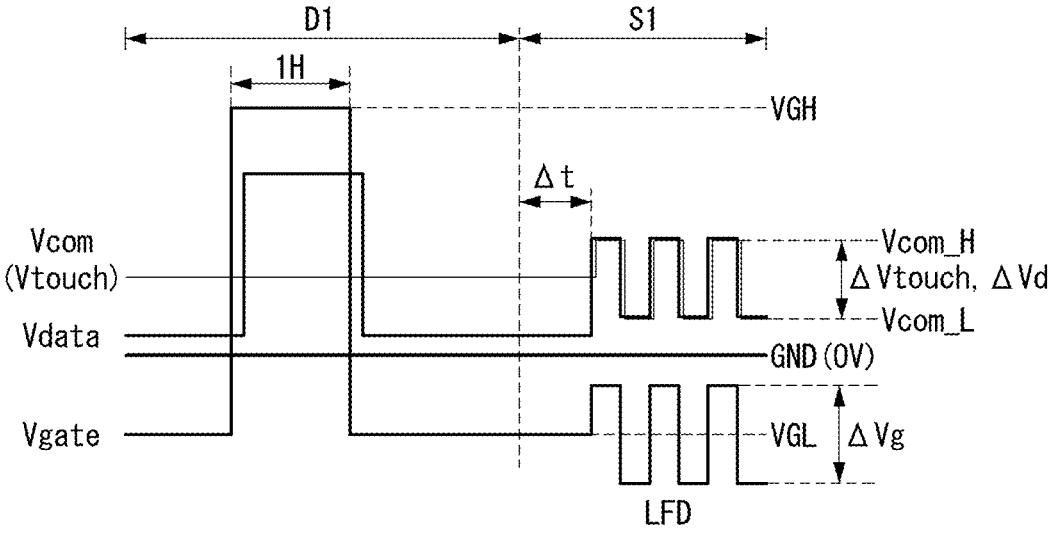

FIGS. 24 and 25 are waveform diagrams illustrating a method of driving the pixels and the touch sensors.

Referring to FIGS. 24 and 25, one frame period may be time-divided into one or more display periods D1 and D2 and one or more touch sensing periods S1 and S2. At a display frame rate of 60 Hz, one frame period is approximately 16.7 ms. One touch sensing period S1 or S2 is allocated between the display periods D1 and D2.

The data driver SIC and the gate driver 120 write current frame data to the pixels in the first block B1 during a first display period D1 to update an image reproduced in the first block B1 with the current frame data. During the first display period D1, the pixels in the other block B2 other than the first block B1 maintain the previous frame data. During the first display period D1, the touch sensor driver RIC supplies a common voltage of the pixels to the touch sensors SE.

During a first touch sensing period S1, the touch sensor driver RIC drives all the touch sensors SE in the screen to sense touch input. Touch data output from the touch sensor driver RIC may be transmitted to the touch sensor controller 320 through a serial peripheral interface (SPI). The touch sensor controller 320 analyzes the touch data, generates touch report data XY including coordinate information and identifier information ID of each touch input, and transmits the touch report data XY to the host system 200.

During a second display period D2, the data driver SIC and the gate driver 120 write current frame data to the pixels in the second block B2 to update an image reproduced in the second block B2 with the current frame data. During the second display period D2, the pixels in the other block B1 other than the second block B2 maintain the previous frame data. During the second display period D2, the touch sensor driver RIC supplies a common voltage of the pixels to the touch sensors SE.

During a second touch sensing period S2, the touch sensor driver RIC drives all the touch sensors SE in the screen to sense touch input. Touch data output from the touch sensor driver RIC may be transmitted to the touch sensor controller 320 through the SPI. The touch sensor controller 320 analyzes the touch data, generates touch report data XY including coordinate information and identifier information ID of each touch input, and transmits the touch report data XY to the host system 200.

Since the touch sensors SE are connected to the pixels, the parasitic capacitance between the touch sensors SE and the pixels is great. Such parasitic capacitance causes the degradation of the SNR of the touch sensor signal.

During a display period, pixel driving signals Vcom, Vdata, and Vgate are supplied to the pixels. Vcom is a common voltage supplied to a touch sensor electrode, that is, a common electrode, through the sensor lines SL during the display period. Vdata is a data voltage that is supplied to the data lines DL during the display period. Vgate is a gate signal that is supplied to the gate lines GL during the display period. During a touch sensing period, the load free signal LFD shown in FIG. 21 is applied to the data lines DL, the gate lines GL, and the sensor lines SL. The load free signal LFD drives the touch sensors SE and minimizes the parasitic capacitance between the pixels and the touch sensors SE.

During touch sensing periods S1 and S2, the SRIC 110 supplies the load free signal LFD from the parasitic capacitance controller 310 to the data lines DL and the sensor lines SL. During the touch sensing periods S1 and S2, the gate driver 120 supplies the load free signal LFD from the parasitic capacitance controller 310 to the gate lines GL.

A voltage ΔVtouch of the load free signal LFD applied to the sensor lines SL is equal to a driving voltage of the touch sensor SE. The voltage ΔVtouch of the load free signal LFD transitions between Vcom_H and Vcom_L.

In FIG. 25, ΔVtouch=ΔVd=ΔVg. ΔVd denotes the voltage of the load free signal LFD applied to the data lines DL, and ΔVg denotes the voltage of the load free signal LFD applied to the gate lines GL. Accordingly, during the touch sensing periods S1 and S2, there is no voltage difference between two ends of each of a parasitic capacitor between the data line DL and the touch sensor SE, a parasitic capacitor between the gate line GL and the touch sensor SE, and a parasitic capacitor between the sensor lines SL so that parasitic capacitance may be minimized.

In a transition from a display period D1 or D2 to a touch sensing period S1 or S2, a stabilization time Δtd may be required until the waveform and voltage of the load free signal LFD become stable. The stabilization time Δtd may be adjusted according to the parasitic capacitance of the display panel 100 and a touch sensor driving voltage Vtouch. The touch sensor driver RIC is driven after the stabilization time Δtd in order to convert a touch sensor signal into digital data and output touch data.

The load free signal LFD needs to be applied in the same phase across the data lines DL, the gate lines GL, and the sensor lines SL in order to minimize the parasitic capacitance affecting the touch sensor.

Figure 26:
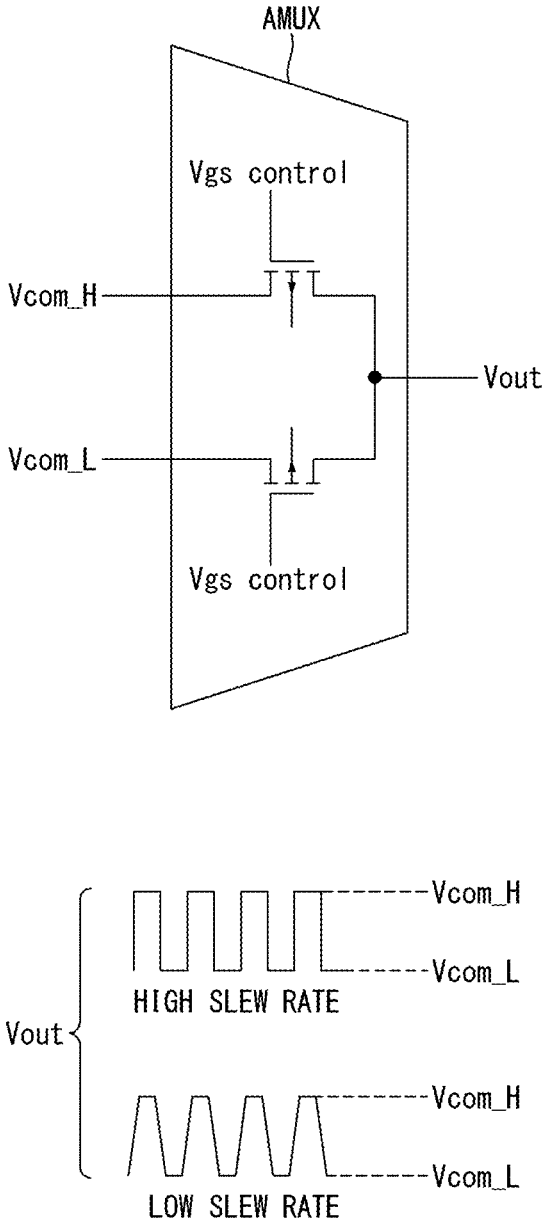
FIG. 26 is a circuit diagram illustrating an analog multiplexer that outputs a touch sensor driving signal.
Figure 27:
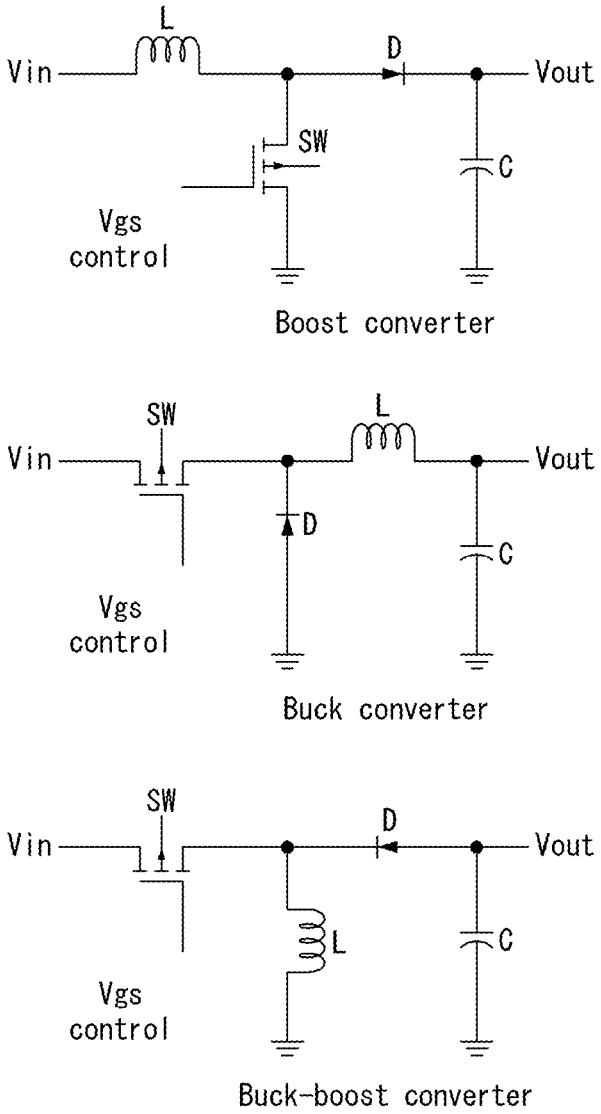
FIG. 27 is a circuit diagram illustrating some circuits of a power supply.

The load free signal LFD, that is, the touch sensor driving signal, may be output through an analog multiplexer AMUX illustrated in FIG. 26. The analog multiplexer AMUX may include a first transistor configured to output a high potential voltage Vcom_H according to a gate-source voltage Vgs, and a second transistor configured to output a low potential voltage Vcom_L according to the gate-source voltage Vgs.

The slew rate of the load free signal LFD needs to be lowered at the transition time. Here, in order to lower the slew rate without being affected by the threshold voltage variation of the transistor, the above-described method of controlling the gate-source voltage may be applied. For example, the gate-source voltage Vgs of the transistors of the analog multiplexer AMUX may be varied such that on-resistance of the transistors has a high value at the beginning of transition time of the load free signal LFD, and then the gate-source voltage Vgs may be controlled to be greater than a threshold voltage of the transistors. To this end, the touch sensor driver may further include a gate-source voltage controller that varies a gate voltage of the first transistor of the transistors of the analog multiplexer in response to a Vgs signal that is varied within the transition time of the load free signal LFD.

FIG. 27 is a circuit diagram illustrating some circuits of the power supply 400.

Referring to FIG. 27, the power supply 400 may include one or more among a boost converter, a buck converter, and a buck-boost converter. The boost converter may convert a voltage level of an input voltage into a voltage level of AVDD and VGH. The buck converter may be used to generate power for logics and HVDD of an IC integrated with the circuits shown in FIGS. 1 and 21. The buck-boost converter may be used to generate VGL.

These converters may each include an inductor L that stores energy, a switching element SW that charges and discharges the energy stored in the inductor L, a capacitor C connected to an output terminal, and the like. The switching element SW is implemented as a transistor. In order to reduce EMI, a gate-source voltage Vgs of the switching element SW in at least one converter among the above-described converters may be controlled by the same method as the above-described embodiment. The power supply 400 may further include a gate-source voltage controller configured to vary the gate voltage of the switching element in response to the Vgs signal being varied.

The above-described embodiments may be applied alone or in combination.

The level shifter and the display device using the same according to an embodiment of the present disclosure may be described as the following embodiments.

The level shifter comprises: a first transistor configured to increase a voltage of an output signal; a second transistor configured to lower a voltage of the output signal; a first driver configured to vary a gate voltage of the first transistor in response to a first Vgs signal being varied within a transition time of the output signal; and a second driver configured to vary a gate voltage of the second transistor in response to a second Vgs signal being varied within a transition time of the output signal.

An on-resistance of at least one of the first and second transistors may be reduced within the transition time as time passes.

A voltage of at least one of the first and second Vgs signals may be varied in the form of at least one of a step waveform, a linear ramp waveform, and a curve waveform.

The second transistor may be an n-channel transistor, and a voltage of the second Vgs signal may be varied within the transition time of the output signal.

The transition time may include at least a first period and a second period after the first period, and the on-resistance of the second transistor is greater in the first period than in the second period.

A voltage difference between the voltage of the second Vgs signal and a threshold voltage of the second transistor may be greater in a second period than in a first period.

The voltage of the second Vgs signal may be lower in a first period than in a second period.

The first transistor may be a p-channel transistor, the second transistor may be an n-channel transistor, and a voltage of each of the first and second Vgs signals may be varied within the transition time of the output signal.

The transition time may include at least a first period and a second period after the first period, and the on-resistance of each of the first and second transistors is greater in the first period than in the second period.

A voltage difference between the voltage of the first Vgs signal and a threshold voltage of the first transistor may be greater in a second period than in a first period. A voltage difference between the voltage of the second Vgs signal and a threshold voltage of the second transistor may be greater in the second period than in the first period.

The voltage of the first Vgs signal may be greater in a first period than in a second period, and the voltage of the second Vgs signal may be lower in the first period than in the second period.

The display device comprises the level shifter. The display device further comprises: a display panel including a pixel array in which data lines and gate lines intersect each other and pixels to which pixel data is written are arranged; a data driver configured to convert the pixel data into a data signal; a demultiplexer array configured to distribute the data signal from the data driver to the data lines; a gate driver configured to sequentially supply a gate signal to the gate lines; a timing controller configured to transmit the pixel data to the data driver and generate a control signal for controlling operation timing of the data driver, the gate driver, and the demultiplexer; and a power supply configured to generate a voltage required for driving the pixel array, the data driver, the gate driver, and the timing controller.

The demultiplexer array may be include a demultiplexer that is connected to one channel of the data driver and receives a data signal from the channel to distribute the data signal to at least two data lines.

The demultiplexer may be include a first switching element connected between the channel of the data driver and a first data line and configured to supply the data signal to the first data line in response to a first MUX signal, and a second switching element connected between the channel of the data driver and a second data line and configured to supply the data signal to the second data line in response to a second MUX signal, The level shifter may output the first MUX signal, a first pseudo MUX signal generated in an opposite phase of the first MUX signal, the second MUX signal and a second pseudo MUX signal generated in an opposite phase of the second MUX signal through the output buffers. Only the first MUX signal among the first MUX signal and the first pseudo MUX signal may be applied to a gate of the first switching element. Only the second MUX signal among the second MUX signal and the second pseudo MUX signal may be applied to a gate of the second switching element.

The display panel further may include a touch sensor.

The display device may further include a touch sensor driver configured to drive the touch sensor by supplying a touch sensor driving signal to the touch sensor The touch sensor driver may include an analog multiplexer configured to select a high potential voltage or a low potential voltage using transistors and output the touch sensor driving signal, and a gate-source voltage controller configured to vary a gate voltage of a first transistor of the transistors of the analog multiplexer in response to a Vgs signal being varied within a transition time of the touch sensor driving signal.

The power supply may include at least one of a boost converter, a buck converter, and a buck-boost converter, and further includes a gate-source voltage controller configured to increase on-resistance of a transistor, which is used as a switching element in one of the boost converter, the buck converter, and the buck-boost converter, and then to lower the on-resistance.

The level shifter of the present disclosure can reduce EMI by reducing a slew rate variation and increasing and decreasing on-resistance of transistors constituting an output buffer within a transition time of an output signal and also minimize the difference in time for the output signal to reach a target voltage which is generated due to a threshold voltage variation in the transistors.

The display device of the present disclosure can improve the output signal quality of output signals of a demultiplexer array, a gate driver, a touch sensor driver, and a power supply using a level shifter and improve the image quality.

A display device of the present disclosure can reduce EMI by generating control signals, for controlling switching elements of a demultiplexer array, as a signal pair having opposite phases.

Effects of the present disclosure will not be limited to the above-mentioned effects and other unmentioned effects will be clearly understood by those skilled in the art from the following claims.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A level shifter, comprising:

a first transistor configured to increase a voltage of an output signal;

a second transistor configured to lower a voltage of the output signal;

a first driver configured to vary a gate voltage of the first transistor in response to a first Vgs signal being varied within a transition time of the output signal; and a second driver configured to vary a gate voltage of the second transistor in response to a second Vgs signal being varied within a transition time of the output signal.

2. The level shifter of claim 1, wherein on-resistance of at least one of the first and second transistors is reduced within the transition time as time passes.

3. The level shifter of claim 1, wherein a voltage of at least one of the first and second Vgs signals is varied in the form of at least one of a step waveform, a linear ramp waveform, and a curve waveform.

4. The level shifter of claim 1, wherein the second transistor is an n-channel transistor, and a voltage of the second Vgs signal is varied within the transition time of the output signal.

5. The level shifter of claim 4, wherein the transition time includes at least a first period and a second period after the first period, and the on-resistance of the second transistor is greater in the first period than in the second period.

6. The level shifter of claim 4, wherein a voltage difference between the voltage of the second Vgs signal and a threshold voltage of the second transistor is greater in a second period than in a first period.

7. The level shifter of claim 4, wherein the voltage of the second Vgs signal is lower in a first period than in a second period.

8. The level shifter of claim 1, wherein the first transistor is a p-channel transistor, the second transistor is an n-channel transistor, and a voltage of each of the first and second Vgs signals is varied within the transition time of the output signal.

9. The level shifter of claim 8, wherein the transition time includes at least a first period and a second period after the first period, and the on-resistance of each of the first and second transistors is greater in the first period than in the second period.

10. The level shifter of claim 8, wherein a voltage difference between the voltage of the first Vgs signal and a threshold voltage of the first transistor is greater in a second period than in a first period, and a voltage difference between the voltage of the second Vgs signal and a threshold voltage of the second transistor is greater in the second period than in the first period.

11. The level shifter of claim 8, wherein the voltage of the first Vgs signal is greater in a first period than in a second period, and the voltage of the second Vgs signal is lower in the first period than in the second period.

12. A display device, comprising:

a display panel including a pixel array in which data lines and gate lines intersect each other and pixels to which pixel data is written are arranged;

a data driver configured to convert the pixel data into a data signal;

a demultiplexer array configured to distribute the data signal from the data driver to the data lines;

a gate driver configured to sequentially supply a gate signal to the gate lines;

a timing controller configured to transmit the pixel data to the data driver and generate a control signal for controlling operation timing of the data driver, the gate driver, and the demultiplexer;

a level shifter configured to convert a voltage of the control signal from the timing controller and supply the converted voltage to at least one of the demultiplexer array and the gate driver; and a power supply configured to generate a voltage required for driving the pixel array, the data driver, the gate driver, and the timing controller, wherein at least one of output buffers of the level shifter includes:

a first transistor configured to increase a voltage of an output signal;

a second transistor configured to lower a voltage of the output signal;

a first driver configured to vary a gate voltage of the first transistor in response to a first Vgs signal being varied within a transition time of the output signal; and a second driver configured to vary a gate voltage of the second transistor in response to a second Vgs signal being varied within a transition time of the output signal.

13. The display device of claim 12, wherein on-resistance of at least one of the first and second transistors is reduced within the transition time as time passes.

14. The display device of claim 12, wherein a voltage of at least one of the first and second Vgs signals is varied in the form of at least one of a step waveform, a linear ramp waveform, and a curve waveform.

15. The display device of claim 12, wherein the demultiplexer array includes a demultiplexer that is connected to one channel of the data driver and receives a data signal from the channel to distribute the data signal to at least two data lines, the demultiplexer includes a first switching element connected between the channel of the data driver and a first data line and configured to supply the data signal to the first data line in response to a first MUX signal, and a second switching element connected between the channel of the data driver and a second data line and configured to supply the data signal to the second data line in response to a second MUX signal, the level shifter outputs the first MUX signal, a first pseudo MUX signal generated in an opposite phase of the first MUX signal, the second MUX signal and a second pseudo MUX signal generated in an opposite phase of the second MUX signal through the output buffers, only the first MUX signal among the first MUX signal and the first pseudo MUX signal is applied to a gate of the first switching element, and only the second MUX signal among the second MUX signal and the second pseudo MUX signal is applied to a gate of the second switching element.

16. The display device of claim 12, wherein the display panel further includes a touch sensor, the display device further includes a touch sensor driver configured to drive the touch sensor by supplying a touch sensor driving signal to the touch sensor, and the touch sensor driver includes an analog multiplexer configured to select a high potential voltage or a low potential voltage using transistors and output the touch sensor driving signal, and a gate-source voltage controller configured to vary a gate voltage of a first transistor of the transistors of the analog multiplexer in response to a Vgs signal being varied within a transition time of the touch sensor driving signal.

17. The display device of claim 12, wherein the power supply includes at least one of a boost converter, a buck converter, and a buck-boost converter, and further includes a gate-source voltage controller configured to increase on-resistance of a transistor, which is used as a switching element in one of the boost converter, the buck converter, and the buck-boost converter, and then to lower the on-resistance.

* * * * *